US005889377A

United States Patent [19]

Mao

[11] Patent Number: 5,889,377

[45] Date of Patent: Mar. 30, 1999

[54] DRAPERY ACTUATOR

[76] Inventor: Kai Ming Mao, 8 Foxwarren Dr., North York, Ontario, Canada, M2K 1L2

[21] Appl. No.: 703,760

[22] Filed: Aug. 27, 1996

[51] Int. Cl.[6] ..... G05B 5/00

[52] U.S. Cl. ..... 318/466; 318/480; 318/282; 318/286; 318/16; 318/256; 318/445; 307/141

[58] Field of Search ..... 318/480, 282, 318/286, 466, 16, 256, 445; 307/141

[56] References Cited

U.S. PATENT DOCUMENTS

| | | | |
|---|---|---|---|
| 970,380 | 9/1910 | Monson . | |
| 2,954,224 | 9/1960 | Schneider et al. . | |
| 3,117,767 | 1/1964 | McLean et al. . | |
| 3,468,061 | 9/1969 | Ozaki . | |
| 3,602,286 | 8/1971 | Hachtel . | |
| 3,653,091 | 4/1972 | McKenna et al. . | |
| 3,688,139 | 8/1972 | Yaguchi . | |
| 4,031,944 | 6/1977 | Morrison et al. | 318/480 X |
| 4,131,831 | 12/1978 | Bochenek et al. | 318/282 |
| 4,347,450 | 8/1982 | Colligan . | |
| 4,481,998 | 11/1984 | Stranberg et al. . | |
| 4,864,201 | 9/1989 | Bernot | 318/480 |
| 4,914,360 | 4/1990 | Hsieh et al. . | |
| 4,955,422 | 9/1990 | Irizarry . | |
| 4,958,112 | 9/1990 | Zerillo | 318/280 |
| 5,242,006 | 9/1993 | Ortega . | |
| 5,273,096 | 12/1993 | Thomsen et al. . | |
| 5,391,967 | 2/1995 | Domel et al. . | |
| 5,392,562 | 2/1995 | Caranbula . | |
| 5,392,832 | 2/1995 | Colson et al. | 160/84.07 |

FOREIGN PATENT DOCUMENTS

| | | |
|---|---|---|
| 1063508 | 1/1976 | Canada . |
| 1109387 | 1/1979 | Canada . |
| 2150911 | 6/1994 | Canada . |
| 2149304 | 3/1995 | Canada . |

*Primary Examiner*—Karen Masih
*Attorney, Agent, or Firm*—Gowling, Strathy & Henderson; D. Doak Horne

[57] ABSTRACT

A drapery actuator to open and close draperies and the like, comprising a housing and a drive pulley supported by the housing to engage a drapery cord. A motor is supported by the housing for reversibility rotating the drive pulley to move the drapery cord between a first extreme position and a second extreme position. A first electrical switch is operatively connected to the motor and a second electrical switch is also operatively connected to the motor. Switch actuator cooperate with the drive pulley such that the first electrical switch is actuated when said drive pulley moves the drapery cord to the first extreme position and the second electrical switch is actuated when the drive pulley is reversibly rotated by the motor to move the drapery cord to the second extreme position whereby when the drapery cord is in the first extreme position and the second extreme position the motor is deactivated and the drapery cord ceases moving.

20 Claims, 20 Drawing Sheets

FIG.6.
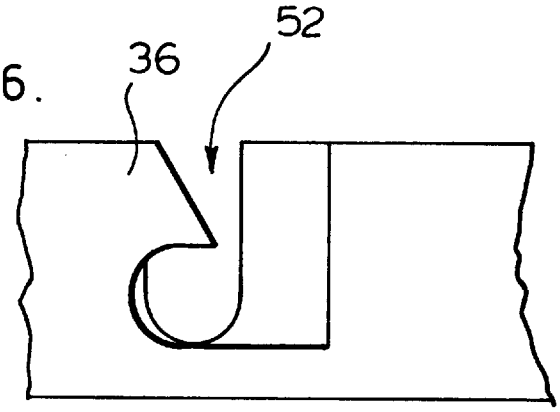
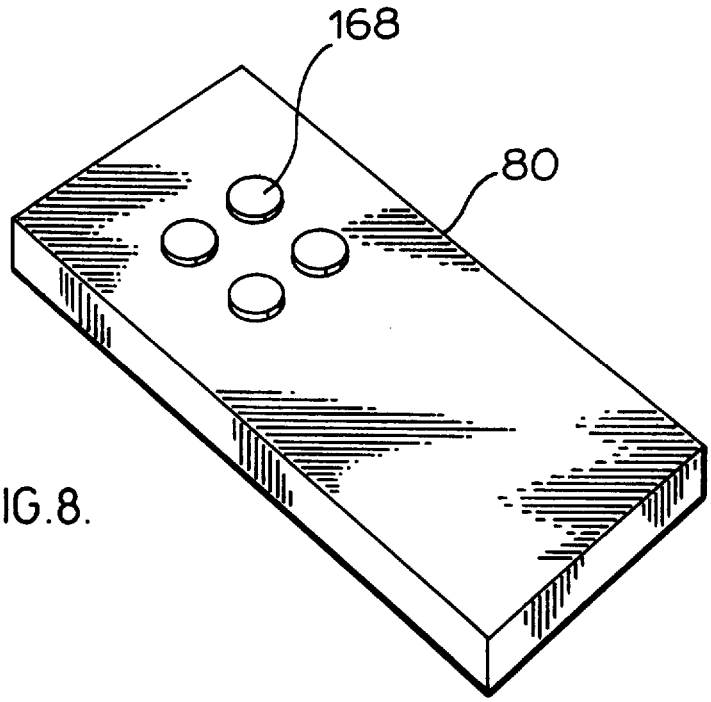
FIG.8.

DRAPERY ACTUATOR

FIELD OF INVENTION

The present invention relates to a drapery actuator and, more particularly, relates to a motorized drapery actuator for opening and closing draperies and the like.

BACKGROUND OF THE INVENTION

Ordinarily, to open draperies, the draperies are manually moved along a drapery cord between open and closed positions. This, of course, effectively regulates the amount of light entering a room.

It is often desirable to have motorized drapery actuators to open and close draperies. Such drapery actuators have a drive pulley to engage a drapery cord which engages draperies and the like. Actuation of the drive pulley opens and closes the draperies. There must be proper tension on the drapery cord to enable the drive pulley to effectively move the drapery cord.

Such drapery actuators are mounted on a wall to enable the drive pulleys to engage the drapery cord to open and close the draperies.

Actuators which are operated by wireless remote control are known. For example, U.S. Pat. No. 4,958,112 which issued Sep. 18, 1990, to Zerillo discloses a drapery actuator. A pull cord is affixed to a drapery rod, which has drapes mounted thereon, to form a bight with vertical and parallel reaches. The drapery actuator has a pair of limit switches in the form of single pole, single-throw normally open reed switches to variably regulate the open and closed positions of the drapes. These switches are actuated by drapery actuators which are magnets affixed to the reaches at positions corresponding to the open and closed positions of the drapes. When a magnet is in actuation position with a limit switch, the switch closes completing the electrical circuit. When a magnet moves away from a switch, the switch will return to an open position preventing electricity from passing beyond the switch. The magnets are manually adjusted along the reaches to correspond to the desired open and closed positions of the drapes. As the drapes are opened and closed, the pull cord may stretch due to wear on the pull cord causing the pull cord to slacken slightly. The magnets will then have to be manually adjusted along the reaches for opening and closing of the drapes. The positioning of the magnets on the vertical reaches to open and close the switches is limited to the length of the vertical reaches. Since the open and closed positions of the drapes are regulated by the magnets, those positions are also limited by the lengths of the reaches. The length of the reaches must be at least as long as the drapery rod and the width of the drapes on the drapery rod or the magnets will engage the switches in a position where the drapes are not fully open or fully closed. Thus, this device would not be suitable for long drapery rods, i.e. wide windows or wall coverings, where the room has a low ceiling since the vertical reaches would be shorter in length than the length of the drapery rod causing the magnets to engage the switches when the drapes are not fully open or fully closed.

U.S. Pat. No. 4,914,360 which issued Apr. 3, 1990 to Hsieh et al. discloses a venetian blind controller for controlling the opening and closing of a vertical venetian blind and for controlling the angular position of the blades by means of two separate motors, each motor having an electromagnetic clutch means to allow manual operation in the event of a power failure.

U.S. Pat. No. 3,117,767 which issued Jan. 14, 1974 to McLean et al. discloses a motorized drapery puller having a casing which supports a motor driven pulley. The casing and pulley are slidably positionable within a bracket to allow variable positioning of the pulley to engage a drapery cord.

It is desirable to have a motorized drapery actuator which does not frequently require manual adjustment of actuators to regulate the open and closed positions of the draperies and which may be used to regulate open and closed positions of draperies for different widths of windows and wall coverings.

SUMMARY OF THE INVENTION

Accordingly, in order to substantially overcome or mitigate at least one of the disadvantages of the prior art, the present invention provides for a drapery actuator which has a switch actuating means to provide for automatic shut off of the drapery actuator when the drapery cord is in two extreme positions.

In its broad aspect, a drapery actuator in accordance with the present invention comprises a housing and a drive pulley supported by the housing to engage a drapery cord which is attached in some manner to a drape. As used herein and claimed, the term 'drape', 'draperies', and/or 'drapes' are intended to include curtains, vertical blinds, and any other wall or window covering or divider which is moved between positions, typically open and closed positions, by a drapery cord. A motor is supported by the housing for reversibly rotating the drive pulley to move the drapery cord between a first position and a second position, which when said drapery cord is in such first position the curtain is typically fully open, and when the drapery cord is in such second position, the drape is typically fully closed. First and second electrical switches are operatively connected to the motor. A torque-activated switch means cooperates with the drive pulley such that the first electrical switch is actuated to deactivate the motor when the drive pulley moves the drapery cord to the first position, when the drape is open, and the second electrical switch is actuated to deactivate the motor when the drive pulley is reversibly rotated by the motor to move the drapery cord to the second position, when the drape is typically in the fully closed position. The motor allows the drape to be moved to extreme open, extreme closed or intermediate positions. The torque-activated switch means provides automatic shut-off of the motor at the extreme open and extreme closed positions but the drapes can be positioned at intermediate positions.

In particular, the torque-activated switch means is adapted to activate the first electrical switch when the drive pulley moves the drapery cord in a first direction to the first position, wherein the drape is typically in the fully open position, so as to cause the first electrical switch to deactivate the motor and prevent further movement of the drapery cord in such first direction. The torque-activated switch means is further adapted to activate the second electrical switch when the motor is reversed and the drive pulley moves the drapery cord in a second opposite direction to the second position in which the drape is typically in the fully closed position, so as to cause the second electrical switch to deactivate the motor and prevent further movement of the drapery cord in the second direction. Accordingly, in a broad aspect of the present invention, a drapery actuator to open and close a drape is provided, comprising a housing and a drive pulley supported by the housing. The drive pulley is adapted to engage a drapery cord. A motor is provided to provide torque for reversibly rotating the drive pulley so as to move the drapery cord in a first direction to a first position, and to move the drapery cord in a second opposite direction to a second position. First and second electrical switches, operatively connected to the motor, are provided. Torque-activated switch means are provided to actuate the first and second electrical switches, and in particular such switch means is adapted to actuate the first electrical switch when the drive pulley moves the drapery cord to the first position, and is further adapted to activate the second electrical switch when the drive pulley is reversibly rotated by the motor to move the drapery cord to the second position, so as to cause the first electrical switch to deactivate the motor when the drapery cord is moved to the first position thereby preventing further movement of the drapery cord in the first direction, and to cause the second electrical switch to deactivate the motor when the drapery cord is moved to the second position thereby preventing further movement of the drapery cord in the second direction.

Preferably, the torque-activated switch means is an actuator arm which is pivotable between a position where it actuates the first electrical switch and a position where it actuates the second electrical switch.

Typically, drapes in the form of a pair of vertical drapes which separate from each other to allow sunlight to pass through a window, when at a fully open position cannot be opened further due to each drape reach; the end of the curtain rod. Likewise when the drapes are in the fully closed position they cannot be further closed due to the respective pairs abutting each other. These serve as drape movement limiting means. The torque necessary to be supplied by the motor to continue to move the drapery cord is essentially an infinite amount of torque at these two extreme positions, since no further movement of the drape once in the first (open) position or in the second (closed) position can occur. Accordingly, in operation, in the preferred embodiment of the present invention, the actuator arm pivots between the first position and the second position upon the torque provided by the motor to the drive pulley exceeding an pre-defined limit, which in a further preferred embodiment may be adjustably preselected by varying rotational friction which occurs between the actuator arm and the housing when the motor is actuated. The drape movement limiting means causes the torque provided by the motor to the drive pulley to reach the upper predefined limit upon the drapery cord being moved to each of the first and second positions.

Preferably, the drapery actuator includes means for varying the mounted position of the housing relative to a support surface to allow adjustment of the tension on the drapery cord. In the preferred embodiment such means comprises the support surface having a plurality of linearly spaced apertures to allow adjustable positioning of housing in this selected one of said apertures.

Also preferably, the housing includes means for varying the position of the housing on the means for attaching the drapery actuator to the support surface to further vary the tension on the drapery cord. In the preferred embodiment such means comprises a helical thread, which upon turning of helical thread allows movement of the housing relative to the support surface.

Also preferably, a receiver circuit and a remote controller are provided to provide remote control of the drapery actuator.

BRIEF DESCRIPTION OF THE DRAWINGS

Embodiments of the present invention will now be described, by way of example only, with reference to the attached Figures, wherein:

FIG. 6 is an enlarged fragmentary side elevational view of a detent of the mounting bracket of the drapery actuator shown in FIG. 1;

FIG. 8 is a perspective view of a remote controller for the drapery actuator shown in FIG. 1;

DETAILED DESCRIPTION OF PREFERRED EMBODIMENTS OF THE INVENTION

Figure 1:
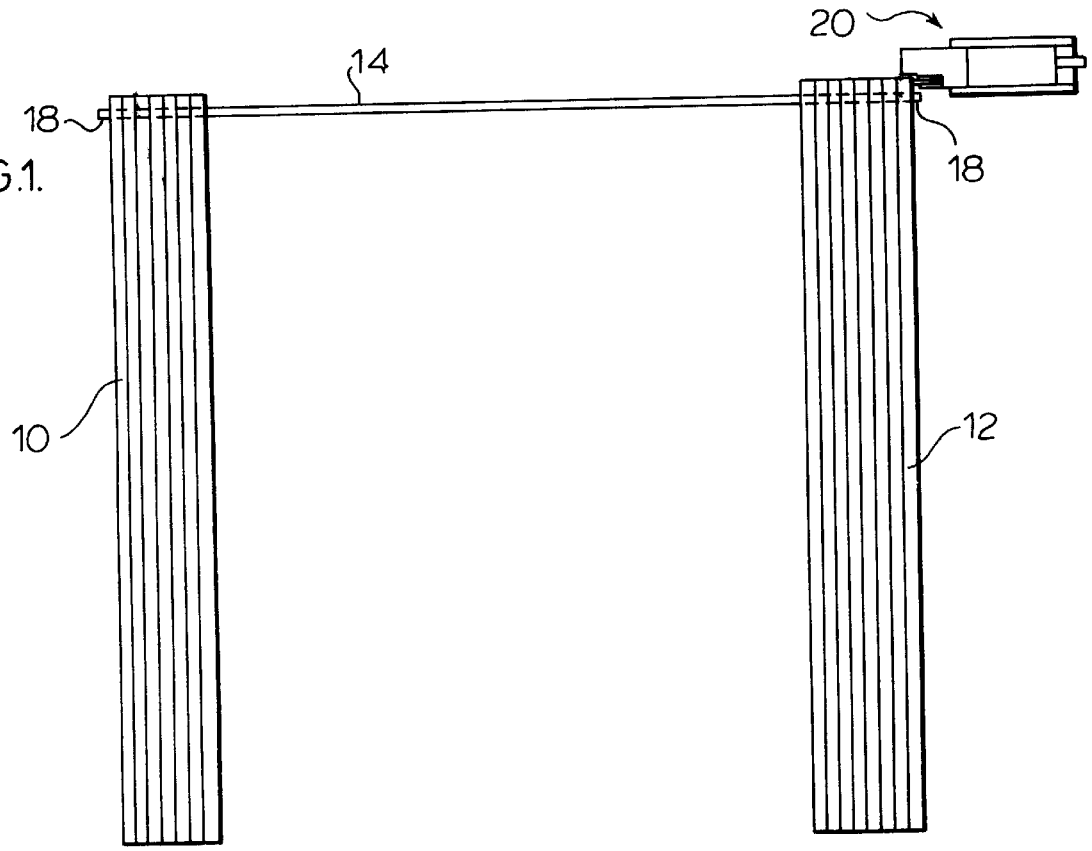
FIG. 1 is a front view of a drapery actuator, in accordance with an embodiment of the present invention, mounted on a wall and engaging a drapery cord having draperies in an open position.
Figure 2:
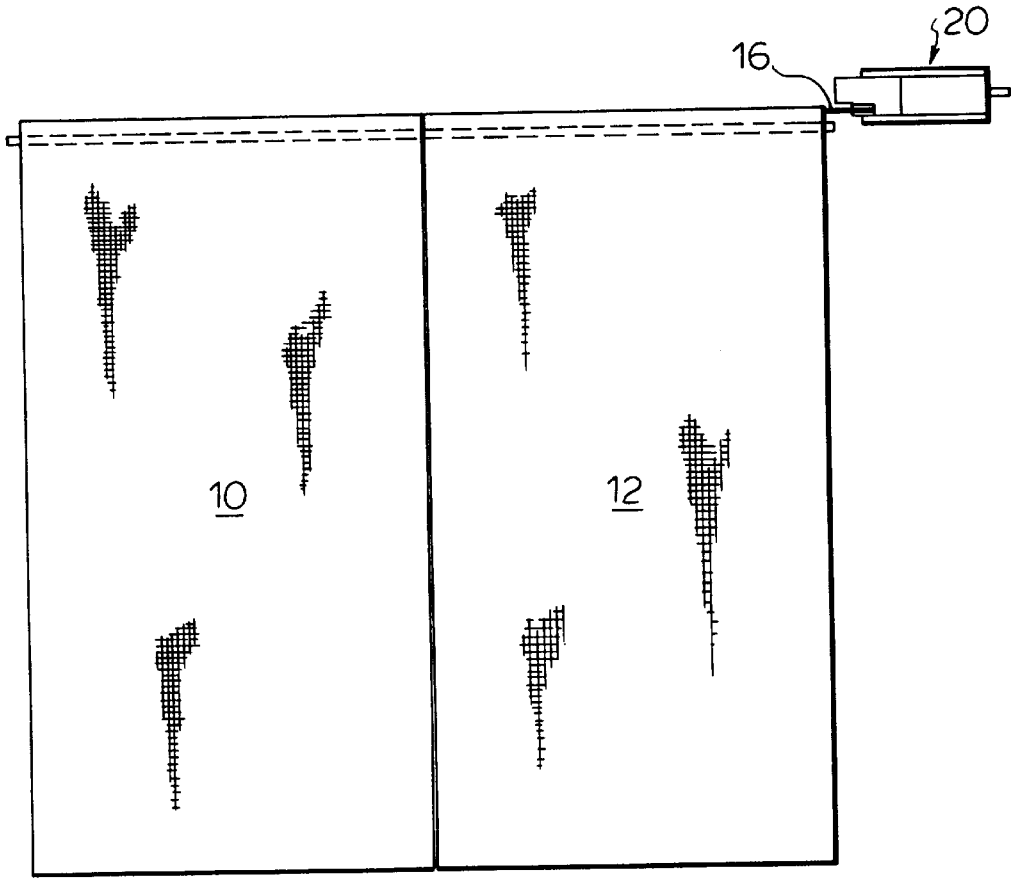
FIG. 2 is a front view of the drapery actuator shown in FIG. 1 with the draperies in a closed position.

Referring first to FIGS. 1 and 2, drapes 10 and 12 are mounted in the usual manner on a curtain rod 14. A drapery cord 16 is disposed above the curtain rod 14 and engages drapes 10 and 12. Drapes 10 and 12 are mounted on the curtain rod 14 proximate a support surface such as a ceiling or a wall 17. As used herein, the terms, "drapery" and/or "drapes", are intended to comprise curtains, vertical blinds, and any other wall or window covering or divider which is moved between positions by a drapery cord. Stops 18 are disposed at either end of the curtain rod 14.

A drapery actuator in accordance with the present invention is depicted as numeral 20 in FIGS. 1 and 2. The drapery actuator 20 is attached to the wall 17 proximate the drape 12 and engages the drapery cord 16. The positioning of the drapery actuator 20 is not particularly limited and may be varied depending on the wall space allotted on either side of drapes 10 and 12.

Figure 3:
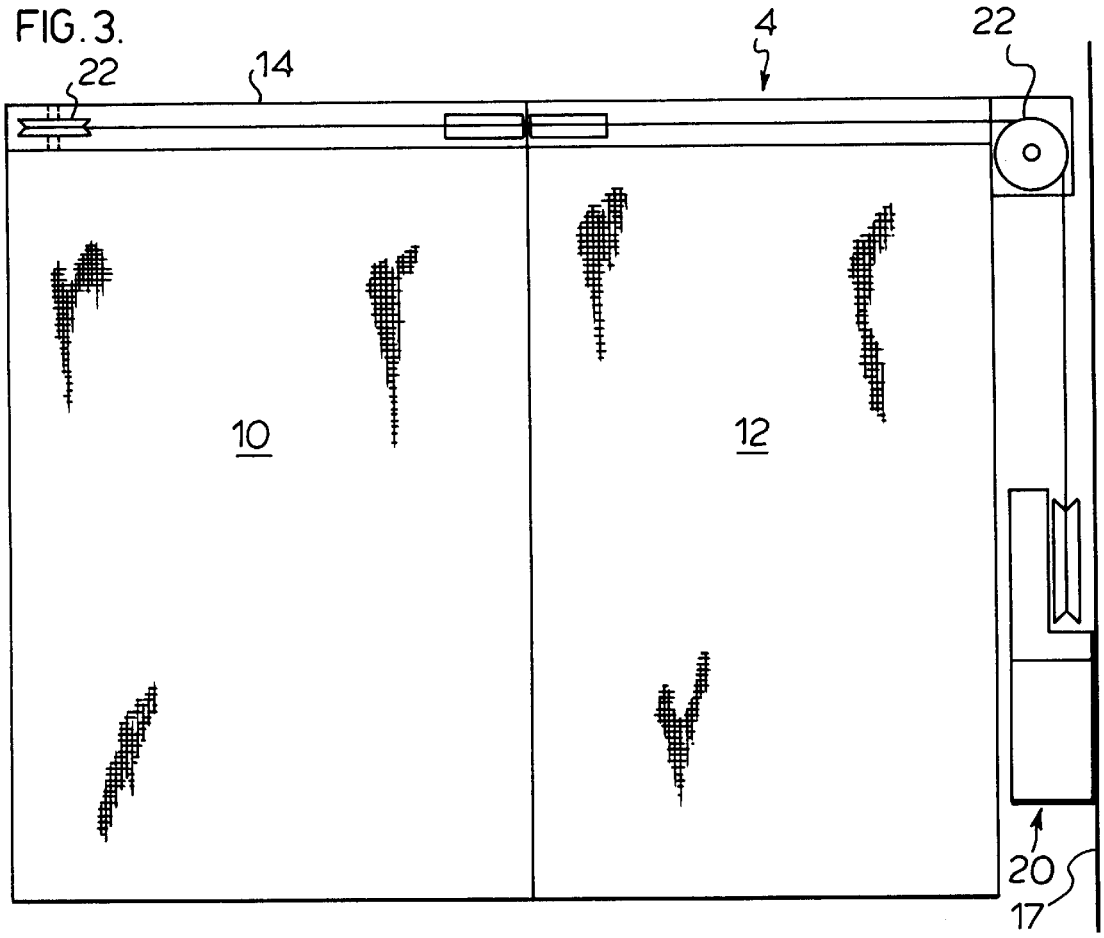
FIG. 3 is a plan view of the drapery actuator shown in FIG. 1 engaging a bight of a drapery cord having draperies in an open position.
Figure 4:
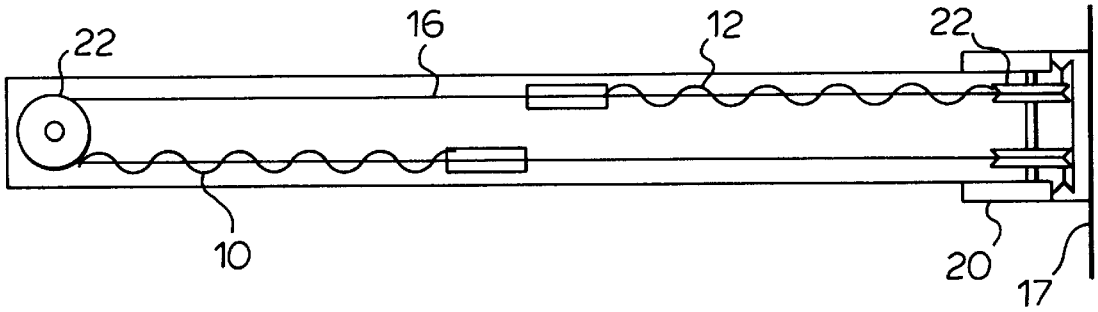
FIG. 4 is a top view of the arrangement of the drapery cord in the direction identified by arrow 4 in FIG. 3.

FIG. 3 shows the drapery actuator 20 mounted in another manner to wall 17. As shown in FIGS. 3 and 4, the drapery cord 16 engages pulleys 22 to form a bight. The drapery actuator 20 then engages the drapery cord 16.

Figure 5:
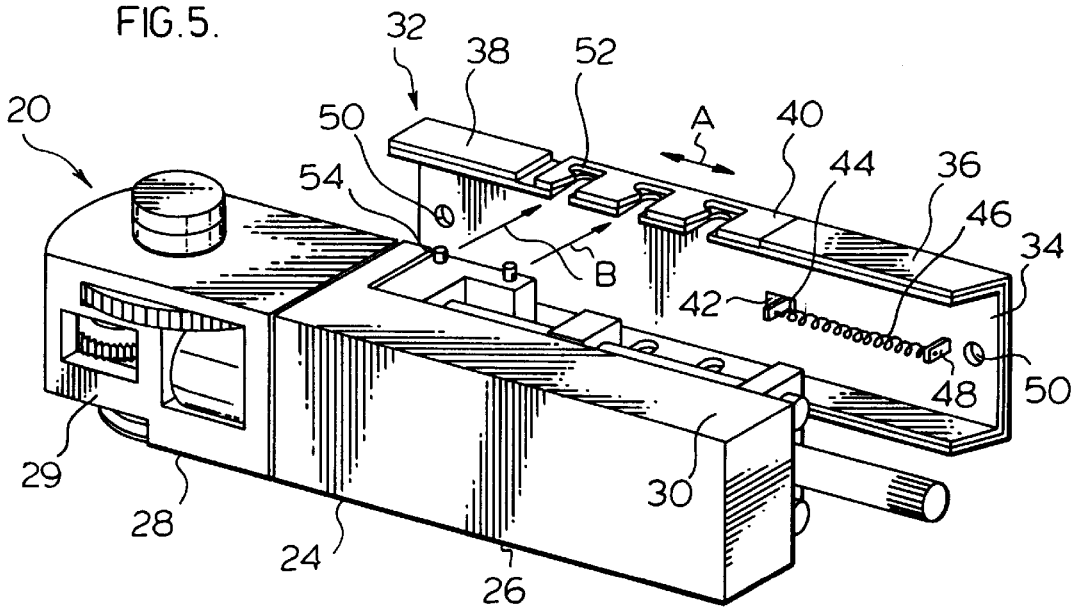
FIG. 5 is a perspective view of the drapery actuator shown in FIG. 1.

Referring to FIG. 5, the drapery actuator 20 has a substantially rectangular-shaped housing 24 which can be fabricated from any suitable material such as plastic. The housing 24 includes an end section 26 with sides 30 and a front section 28. The front section 28 has a top 29 and a bottom (not shown). The drapery actuator 20 also includes a bracket 32 for mounting the drapery actuator 20 onto the wall 17. The bracket 32 comprises an inner metal member 34 and outer plastic covers 36 and 38. A detent 40 is slidable along the outside of the inner frame member 34 between covers 36 and 38 as shown by arrows A and has a post 42 which passes through a slot 44 in the inner frame member 34.

A compression spring 46 is disposed between the post 42 and another post 48 which is affixed to the inner frame member 34. The compression spring 46 aids in maintaining the detent 40 on the inner frame member 34. As the slidable detent 40 moves between the covers 36 and 38 as shown by arrows A, the post 42 moves in the slot 44. The bracket 32 has holes 50 for attachment of the bracket 32 and, thus, the drapery actuator 20, to the wall 17. Screws (not shown) may be threaded through holes 50 into the wall 17.

The bracket 32 also includes a plurality of slots 52 which receive bosses 54 located on the end section 26, further discussed below, as shown by arrows B. Two bosses 54 are located on each of the sides 30 of the end section 26 and fit within corresponding slots 52 in the bracket 32. As shown in FIG. 5, the detent 40 engages the bosses 54 when they are inserted into the slots 52. This causes the bracket 32 to be locked to the end section 26. It will be understood by those of skill in the art that any number of bosses 54 and slots 52 may be used to join the bracket 32 to the end section 26. Preferably, there are more slots than bosses to allow the bosses and the end section 26 to be placed in different positions on the bracket 32.

Figure 7:
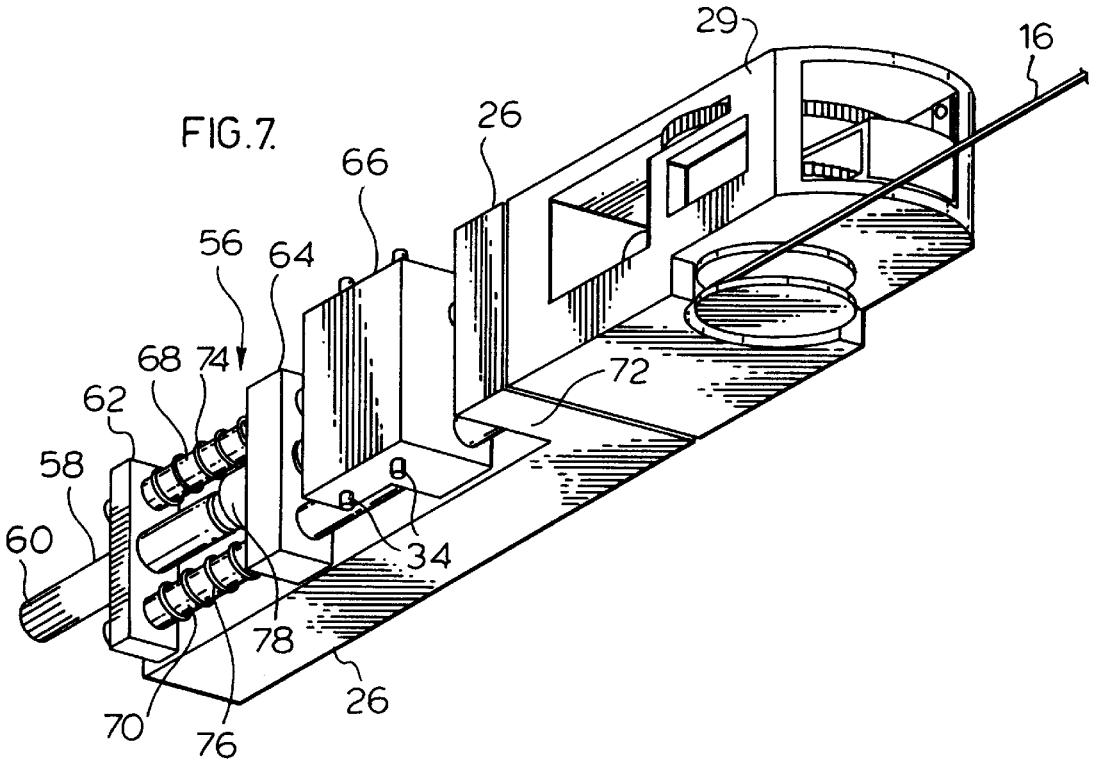
FIG. 7 is a perspective view of the drapery actuator of FIG. 1 with the mounting bracket removed.

Release of the bosses 54 from the slidable detent 40 permits the housing 24 to be removed from the bracket 32 as shown in FIG. 7. FIG. 7 shows a tension maintenance mechanism 56 contained within the end section 26. The tension maintenance mechanism 56 contains a rod 58 which has a serrated end 60. The tension maintenance mechanism 56 also comprises blocks 62 and 64 and L-shaped block 66. The L-shaped block 66 has the bosses 54, discussed above, disposed thereon. The rod 58 passes through block 62 and is threaded into block 64 and abuts block 66.

Block 62 is affixed to rods 68 and 70 which are disposed on either side of the rod 58. The rods 68 and 70 extend through blocks 62, 64 and 66 and are inserted into the wall 72 of the end section 26. The blocks 64 and 66 are slidable along the end section 26. The rods 68 and 70 pass through apertures in block 64, i.e. they are not threaded into block 64. Compression springs 74 and 76 are mounted about rods 68 and 70 respectively to urge block 64 away from block 62. A stop 78 limits the movement of the block 64 on the rod 58.

For operation of the tension maintenance mechanism 56, the bosses 54 are within the slots 52 in the bracket 32 to maintain the housing 24 within the bracket 32. The rod 58 may be rotated clockwise or counterclockwise to move block 64 towards and away from block 62 respectively. At the same time, the block 66 moves towards and away from block 64. As block 64 moves towards block 62 due to the rod 58 being threaded into block 64, the rod 58 pushes block 66 away from block 64 towards the wall 72. Block 66 continues to move towards the wall 72 until the stop 78 abuts block 64. This causes the housing 24 to slide along the bracket 32.

The end section 26 contains a receiver circuit actuated by a hand-held wireless remote control transmitter 80 shown in FIG. 8. In the preferred embodiment, radio signals in the microwave frequencies are used by the control units, however, other signals such as ultrasonic, radio and infrared may also be used or the drapery actuator 20 may be hard wired to an appropriate switch box, not shown.

Figure 9:
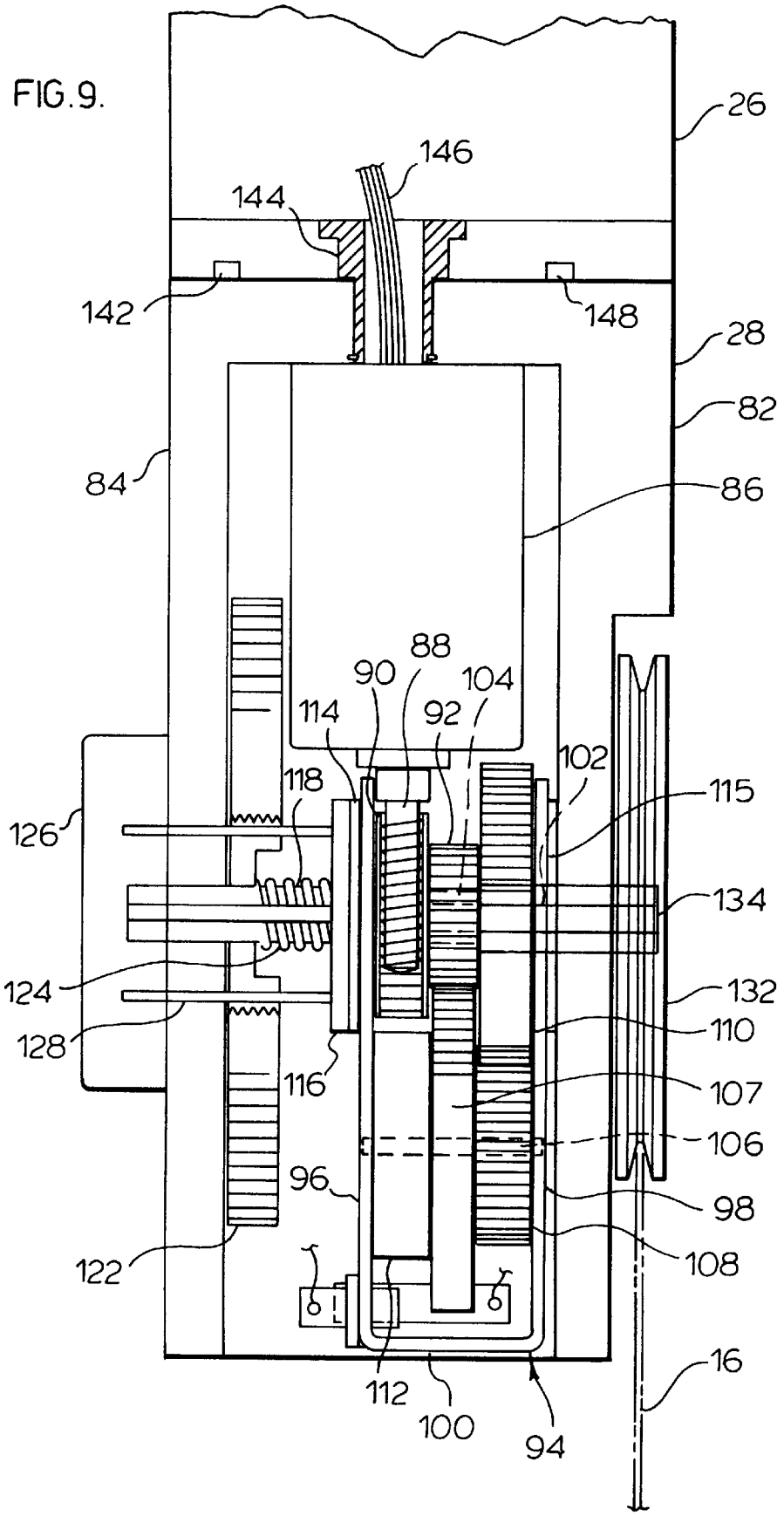
FIG. 9 is a fragmentary top plan view of the drapery actuator of FIG. 1.
Figure 10:
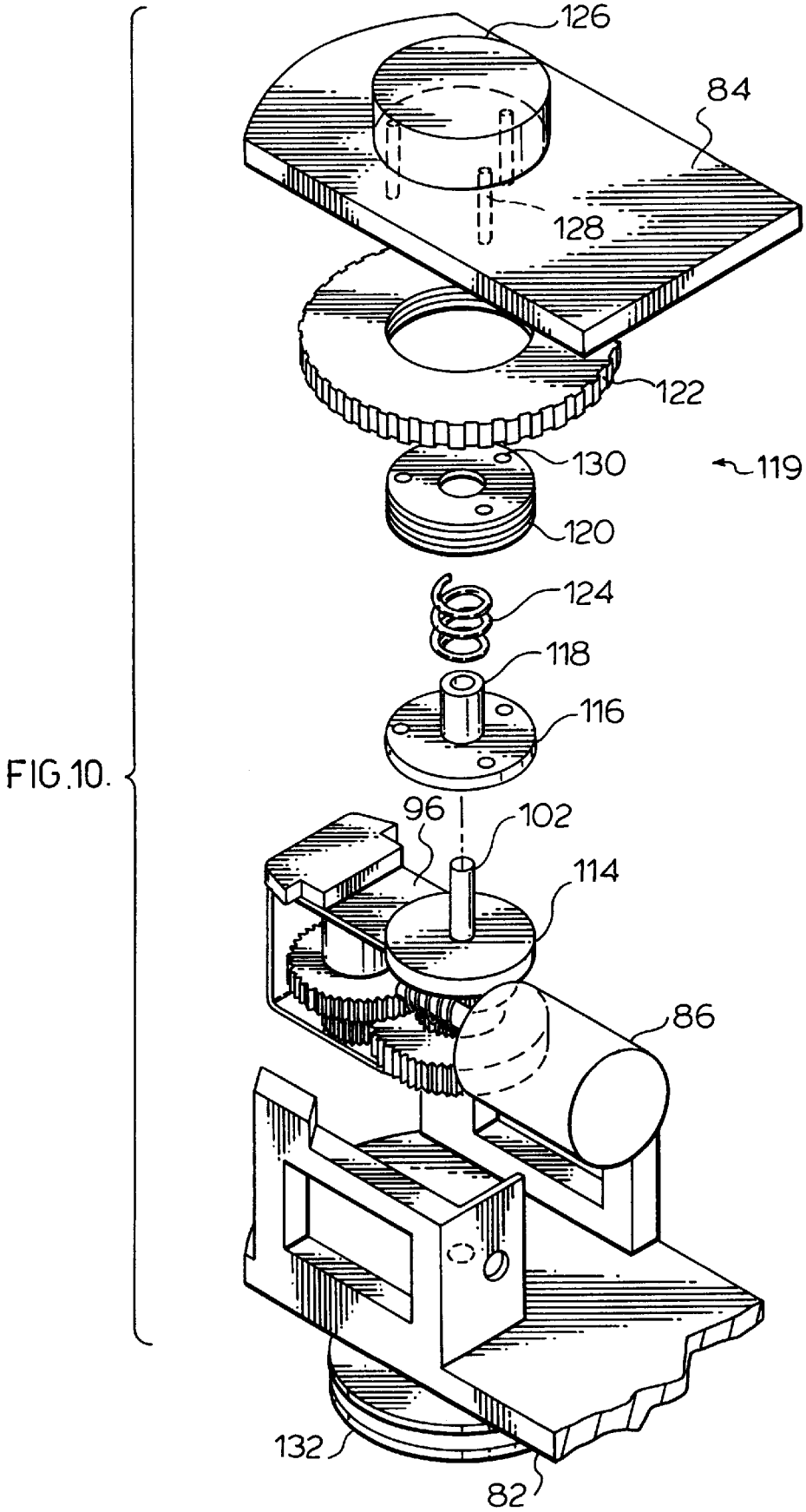
FIG. 10 is a fragmentary exploded perspective view of the adjustable tension limiting means of the drapery actuator shown in FIG. 1.

The front section 28 will now be described in detail with reference to FIGS. 9 and 10. The front section 28 has sides 82 and 84. A reversible motor 86 is located within the front section 28 proximate the end section 26. In this embodiment, the motor 86 is a DC motor but it may be any suitable motor as will occur to those of skill in the art. An appropriate electrical adapter (not shown) is used to connect the drapery actuator 20 to a common AC outlet. Batteries may also be used to provide power to the motor 86.

A worm gear 88 extends from the motor 86 and engages a gear 90. A gear 92 rotates with the gear 90 and has fewer teeth than the gear 90. The gear 90 is proximate an actuator arm 94. The actuator arm 94 is substantially U-shaped and has arms 96 and 98 and a bight 100. The arms 96 and 98 have apertures (not shown) through which a shaft 102 is inserted and which freely rotates within the apertures. The gears 90 and 92 rotate on a collar 104 on the shaft 102 between the arms 96 and 98 of the actuator arm 94. The collar 104 rotates freely on shaft 102.

An axle 106 is disposed between the arms 96 and 98 of the actuator arm 94 and a planetary gear 107 rotates on the axle 106 and engages gear 92. Another planetary gear 108 extends from planetary gear 107 and has fewer teeth than the planetary gear 107. The planetary gear 108 rotates with the planetary gear 107. The planetary gear 108 engages a gear 110 which rotates on the shaft 102. A spacer 112 also extends from the gear 107 and rotates therewith and abuts the arm 96 of the actuator arm 94 to ensure that the gears 107 and 108 are maintained in engagement with the gears 92 and 110 respectively.

A rubber sheath 114 is affixed to the arm 96 between the arm 96 of the actuator arm 94 and a hub 116. The rubber sheath 114 is co-extensive with the hub 116 which is disposed on the shaft 102. Another rubber sheath 115 is affixed to arm 98 of the actuator arm 94. The hub 116 has a hollow shaft 118 which allows the shaft 102 to pass there through as best seen in FIG. 10. The drapery actuator 20 has an adjustable tension limiting means which is depicted generally as 119. The adjustable tension limiting means 119 has an inner wheel 120 within an adjusting wheel 122 which is disposed on the shaft 118. A compression spring 124 is disposed about the shaft 118.

A decorative cover 126 is disposed on the side 84 of the drapery actuator 20 to cover three pins 128. The pins 128 extend from the cover 126 through apertures 130 in the inner wheel 120 and abut the hub 116. The pins 128 are spaced apart from the shaft 118 and are equi-spaced to each other about the circumference of the shaft 118. The pins 128 prevent rotation of the hub 116 with respect to decorative cover 126. The operation of the adjustable tension limiting means 119 is disclosed below. A drive pulley 132 is disposed proximate the sidewall 82 and is affixed to a collar 134. The gear 110 is also affixed to the collar 134 which rotates about the shaft 102. The drapery cord 16 engages the drive pulley 132. As will be apparent to those of skill in the art, drive pulley 132 is sized appropriately for the intended use of drapery actuator 20. For example, if drapery actuator 20 is to be used with vertical blinds, drive pulley 132 can be fabricated with a larger groove as appropriate, or the drive pulley 132 may have a V-shaped groove to enable it to engage various thicknesses of cords.

In a preferred embodiment, the gears of front section 28 are formed of plastic to reduce weight and manufacturing expense. It will be understood that the number of gears may vary. Further, a cover (not shown) may be provided for front section 28 to prevent unintentional access to these gears as an additional safety measure.

Figure 11:
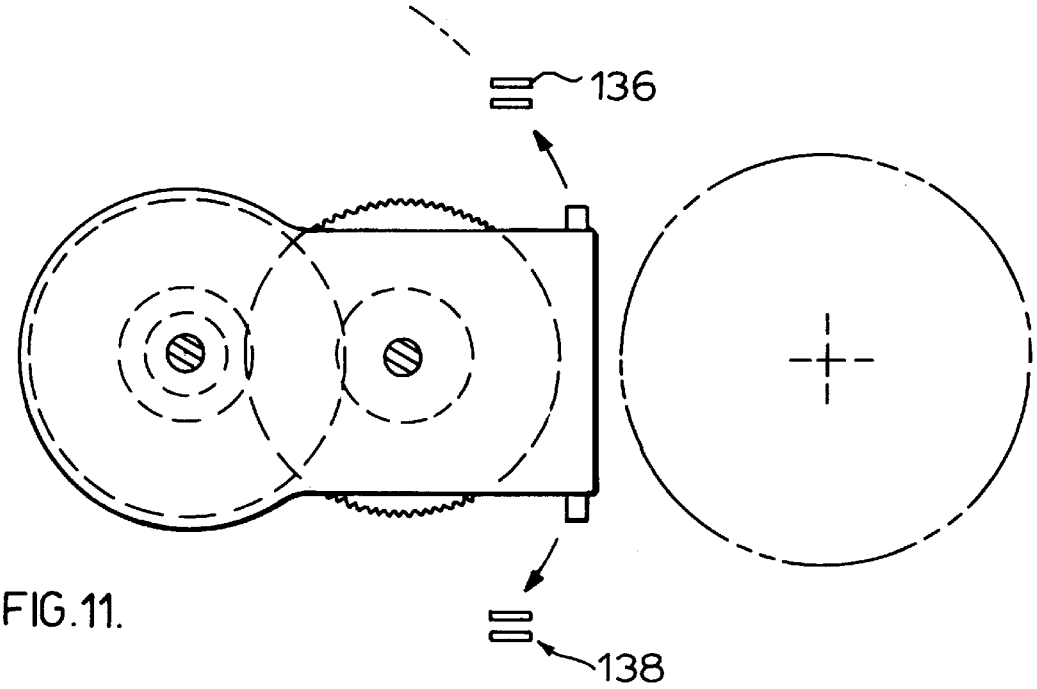
FIG. 11 is a side plan view of the actuator arm between the two electrical switches.
Figure 12:
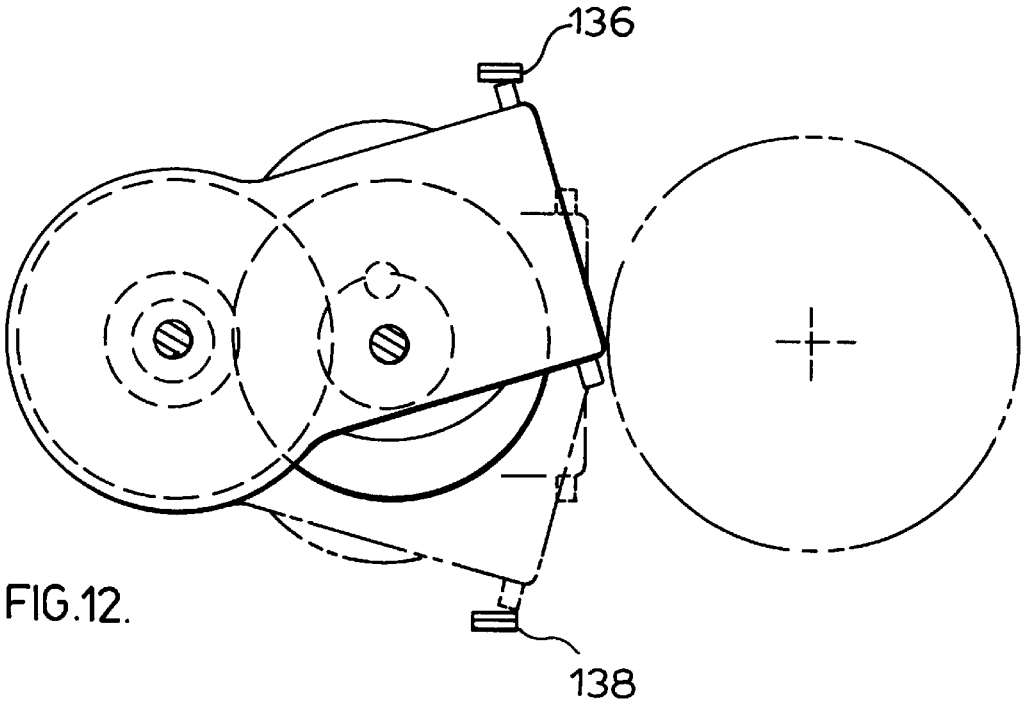
FIG. 12 is a side plan view of the actuator arm in contact with the two electrical switches.

FIG. 11 shows actuator arm 94 and normally open switches 136 and 138 and FIG. 12 shows actuator arm 94 closing switches 136 and 138 at the respective extremities of its range of pivotal movement.

Figure 13:
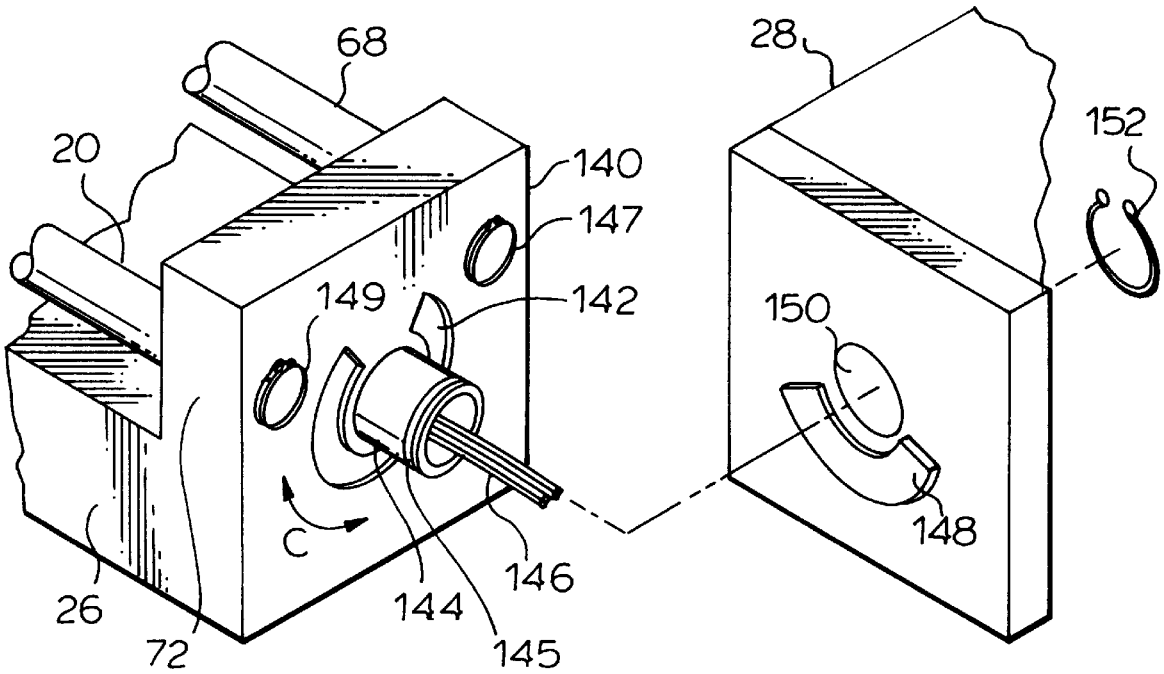
FIG. 13 is a perspective view of the attachment of the end section and the front section of the drapery actuator shown in FIG. 1.
Figure 14:
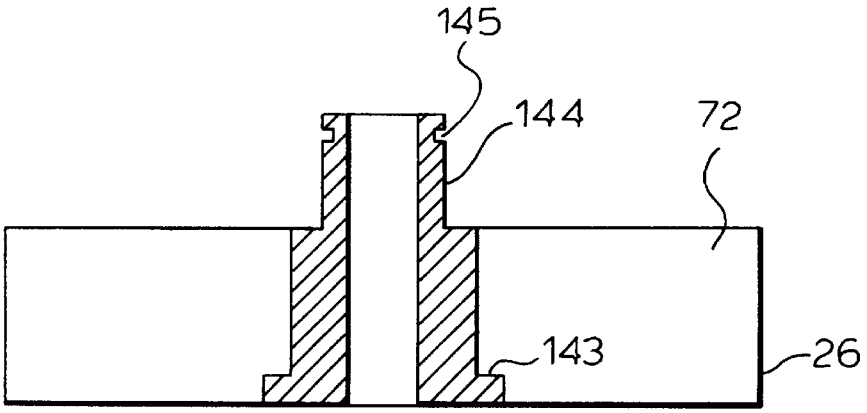
FIG. 14 is a top cross-sectional view of the plug for attachment of the end section and the front section of the drapery actuator shown in FIG. 1.
Figure 15A:
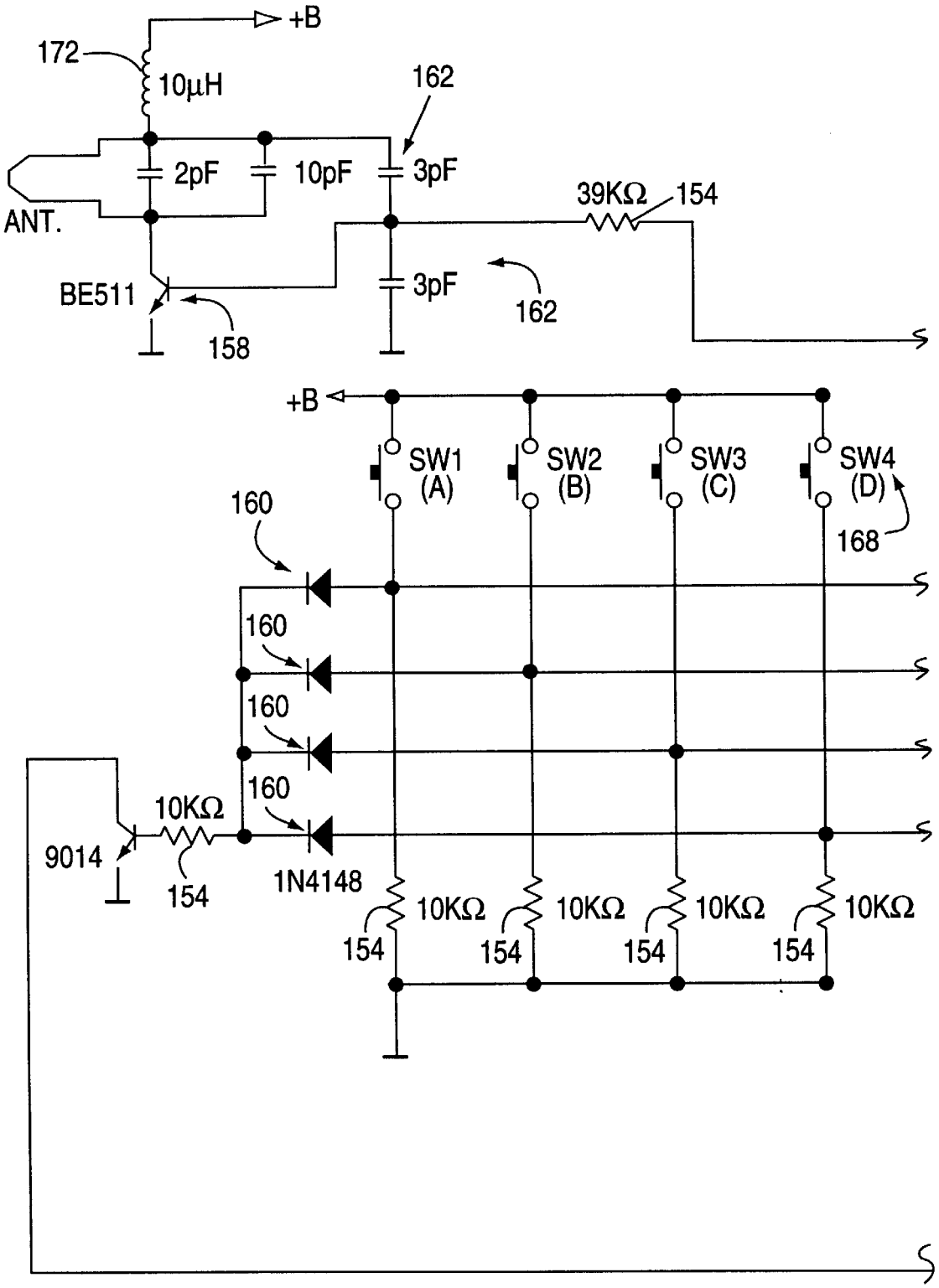
FIGS. 15A and 15B and 16A and 16B are schematic diagrams of the circuitry of the remote controller of FIG. 8.
Figure 15B:
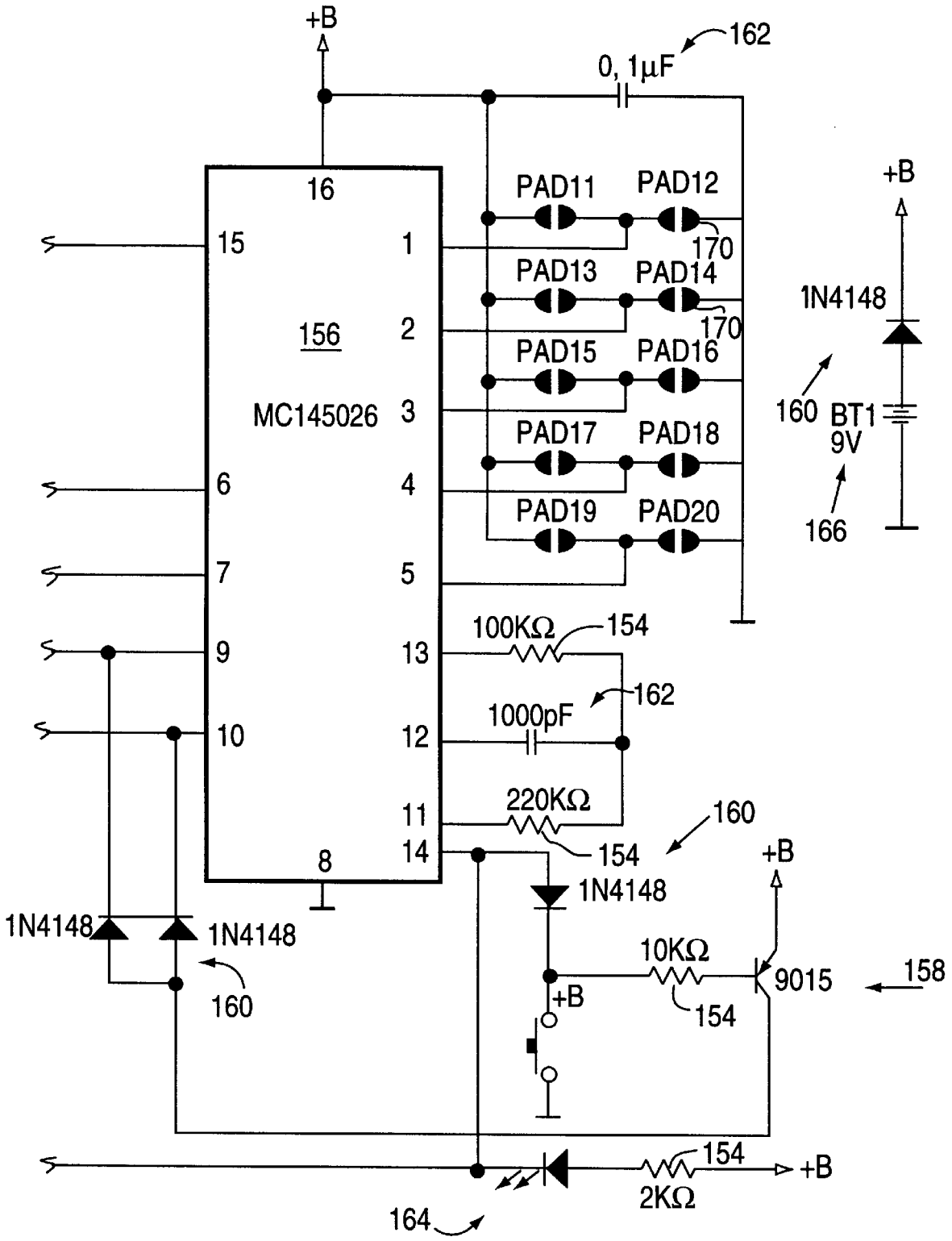
Figure 16A:
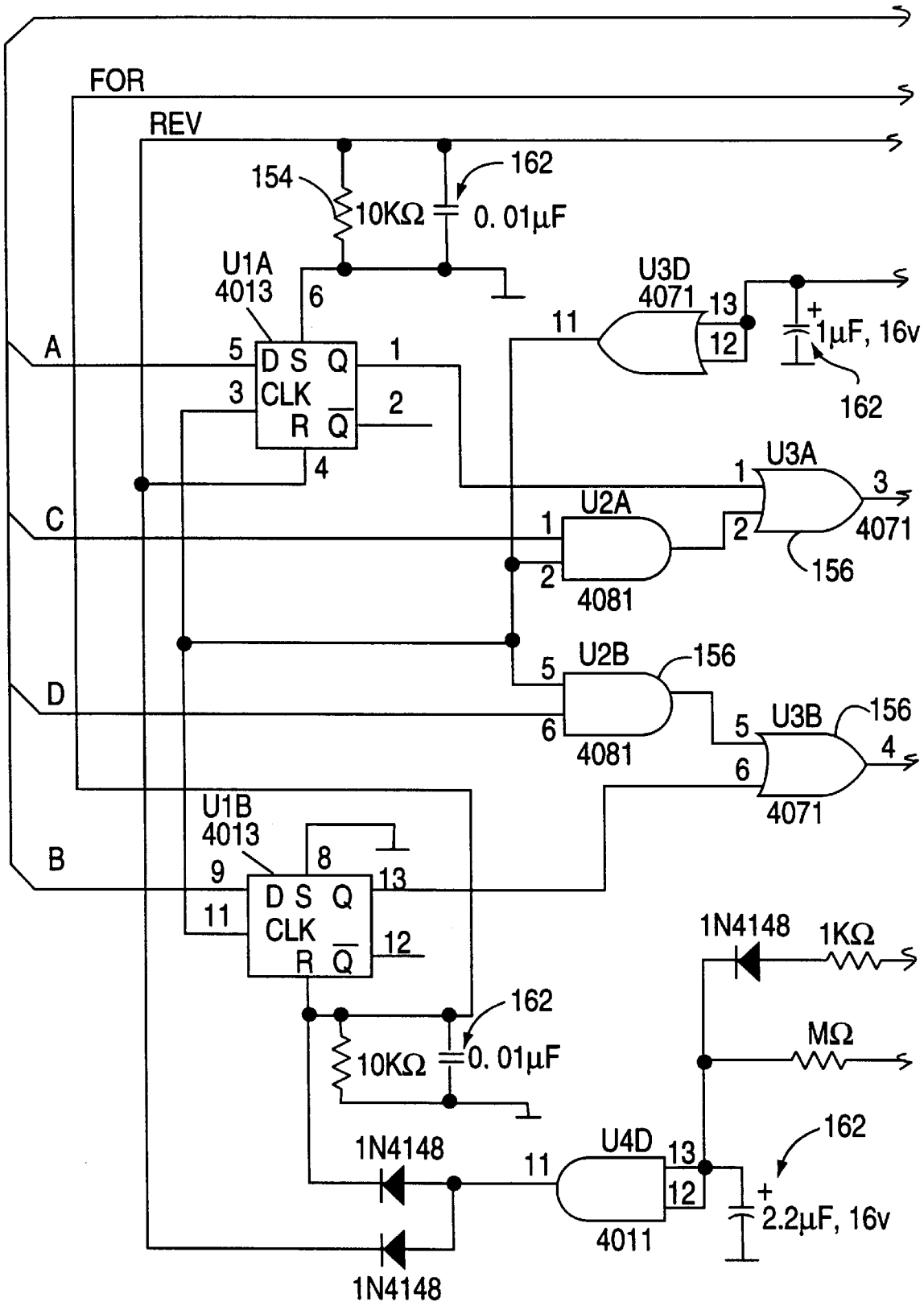
Figure 16B:
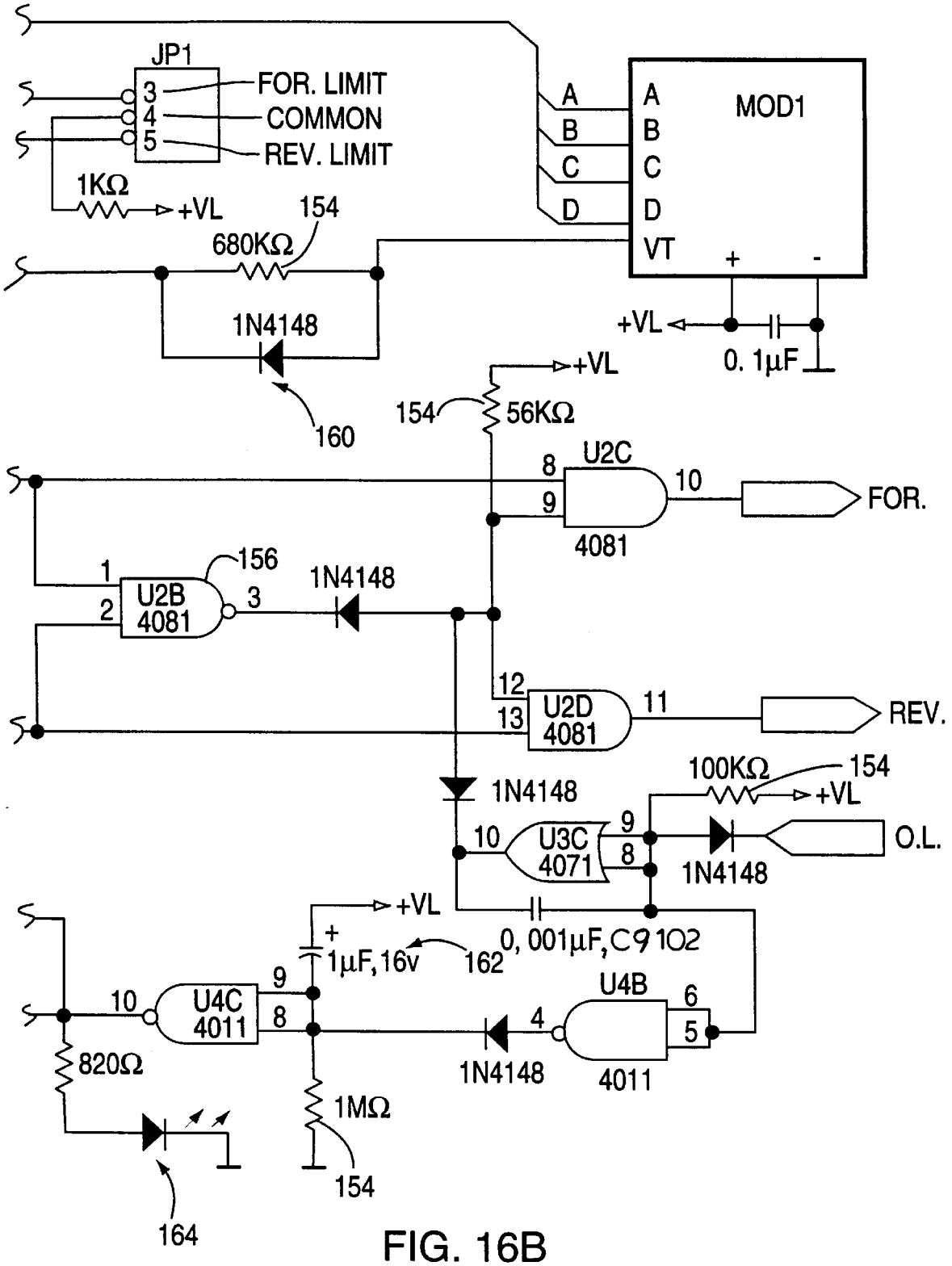
Figure 17A:
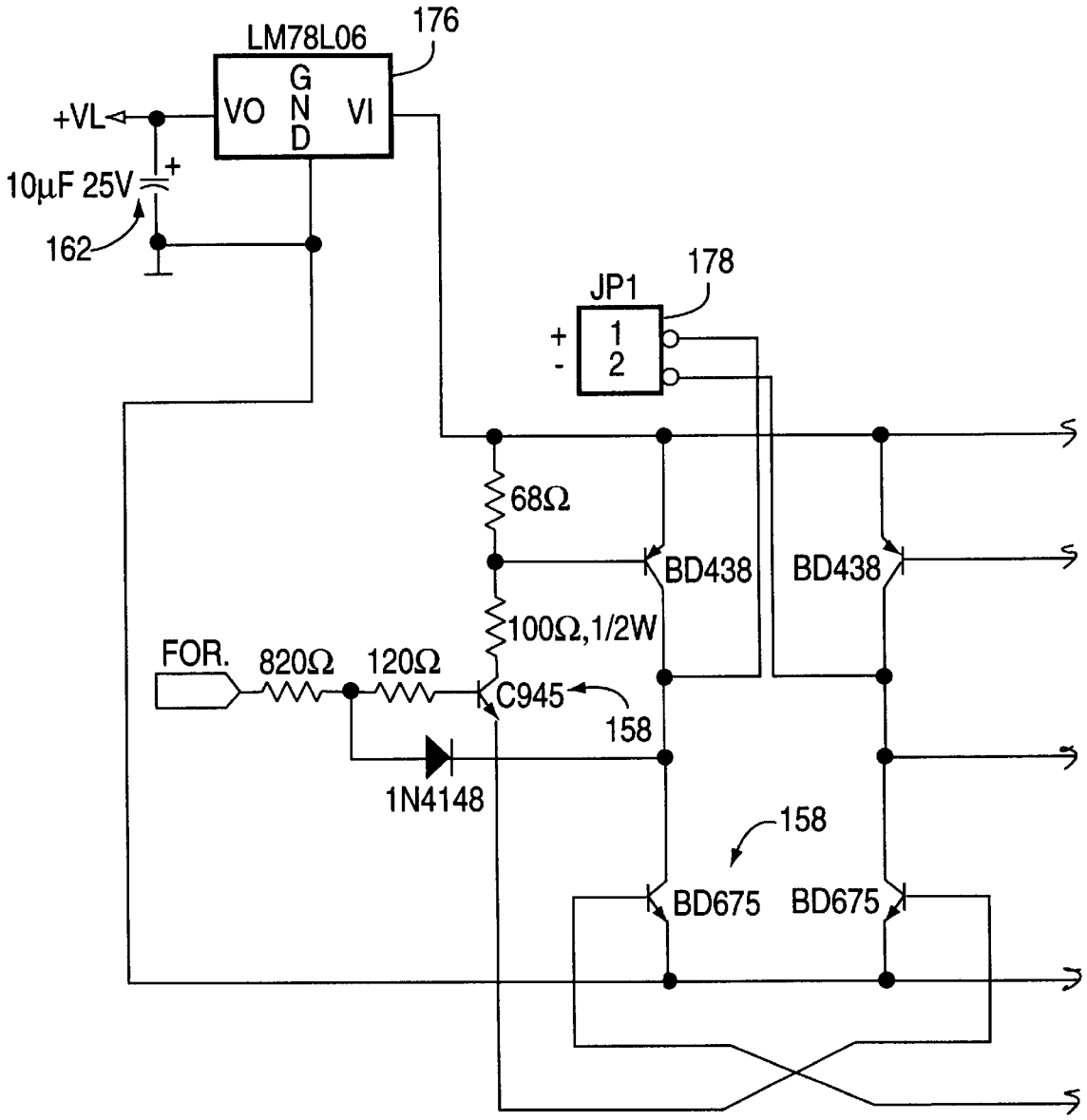
FIGS. 17A and 17B are schematic diagrams showing the power control circuitry of the motor of the drapery actuator.
Figure 17B:
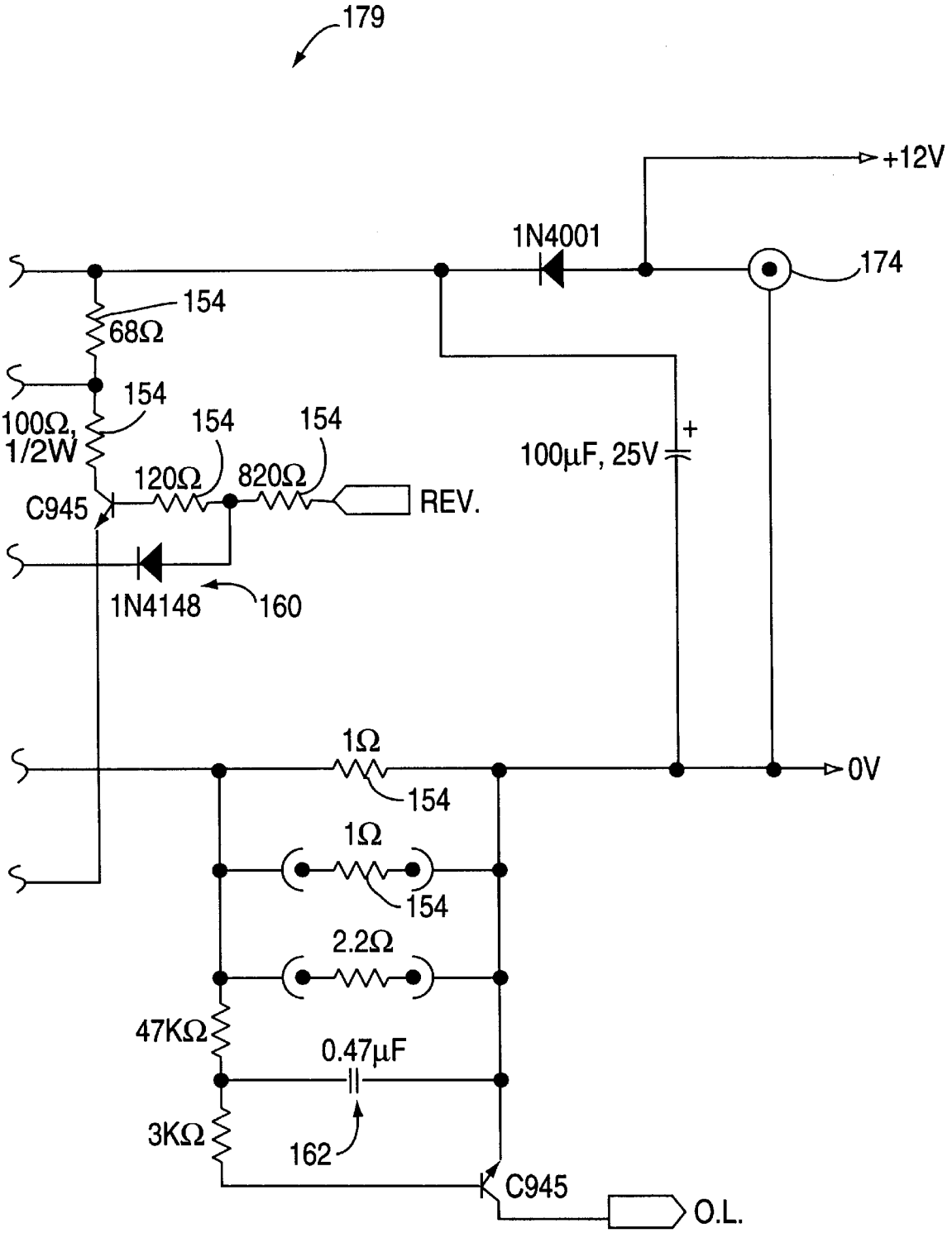
Figure 18A:
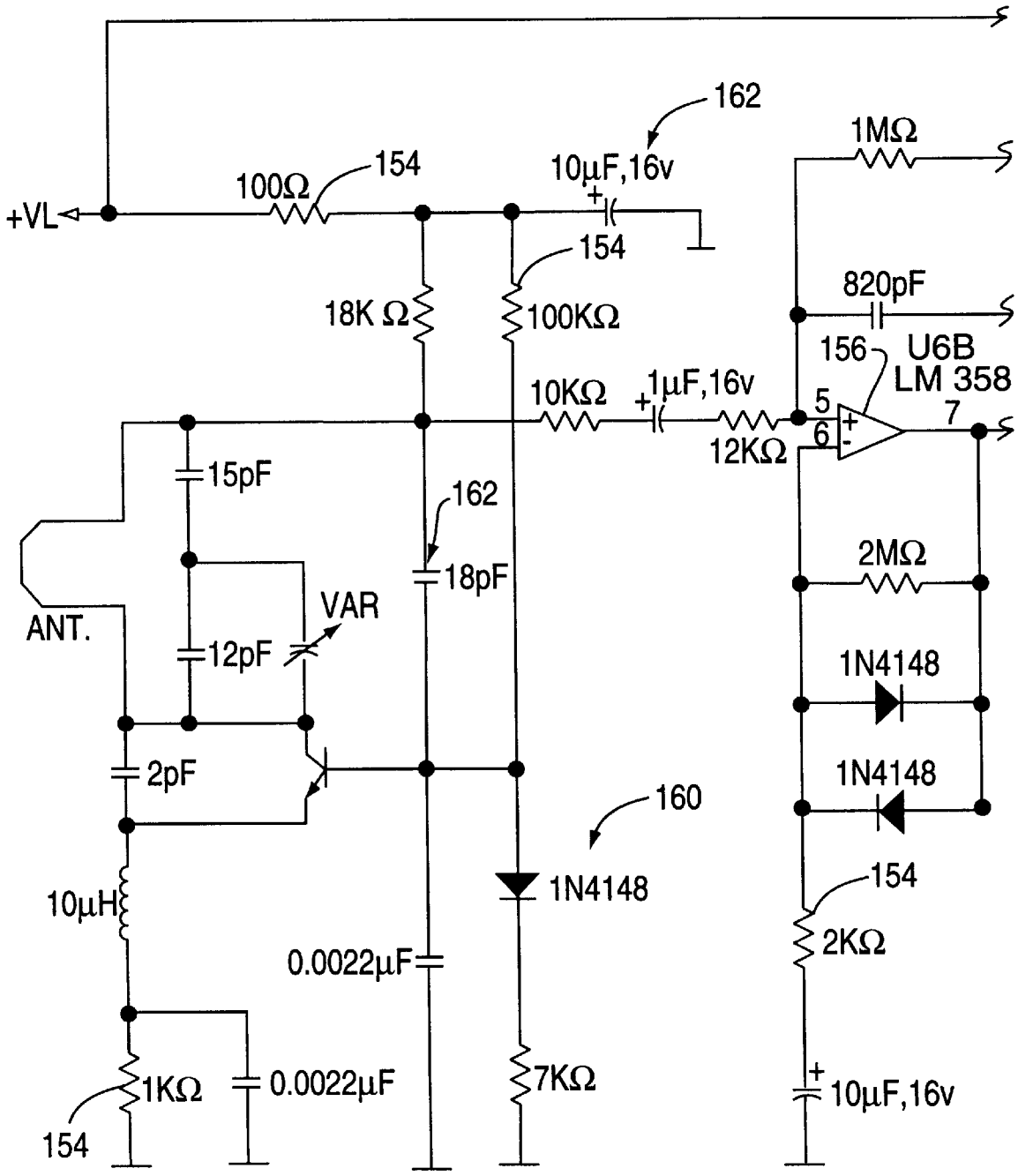
FIGS. 18A and 18B are schematic diagrams of the receiver circuit corresponding to the circuitry of the remote controller shown in FIGS. 15A, 15B and 16A and 16B.
Figure 18B:
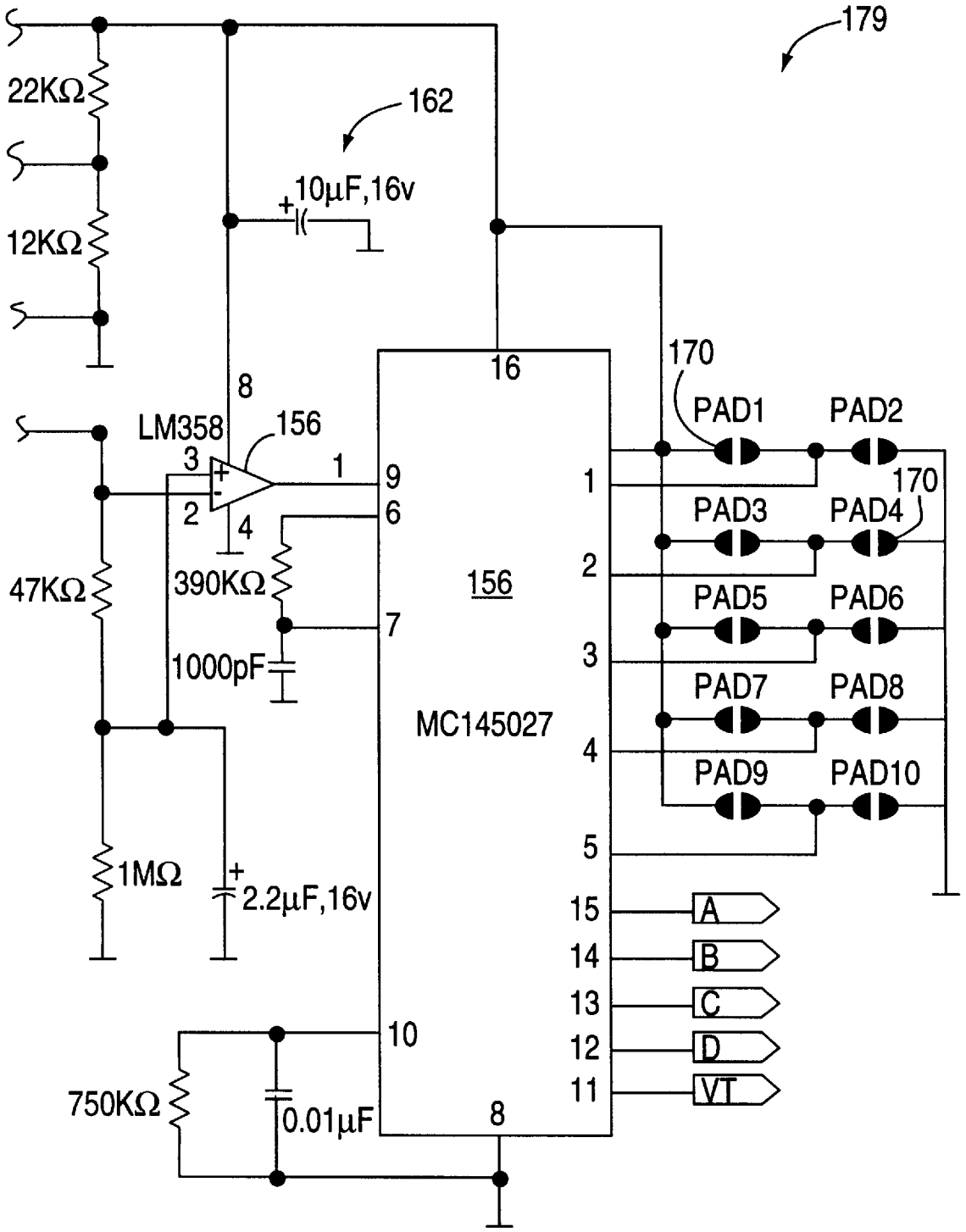
Figure 19:
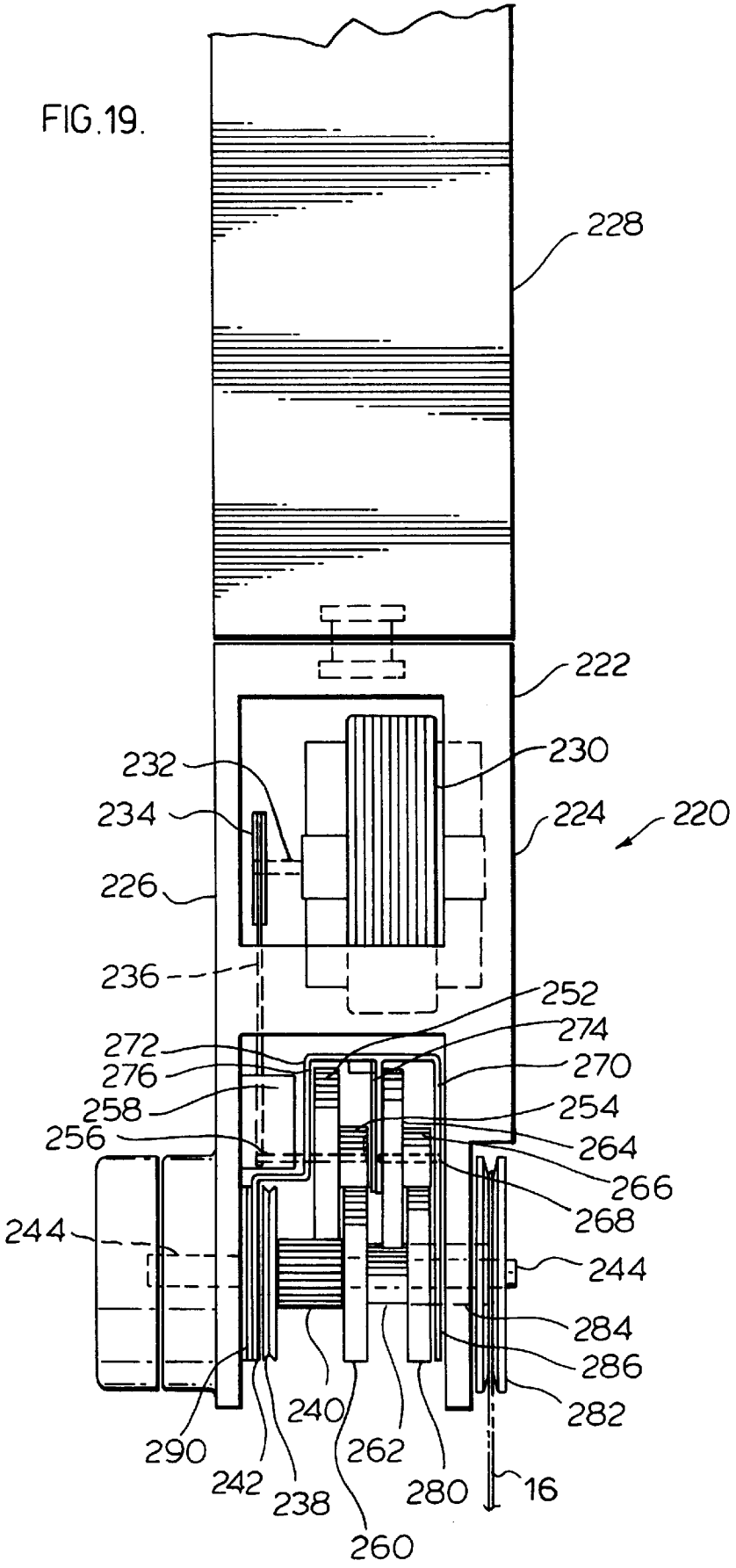
FIG. 19 is a fragmentary top plan view of another embodiment of a drapery actuator in accordance with the present invention.
Figure 20:
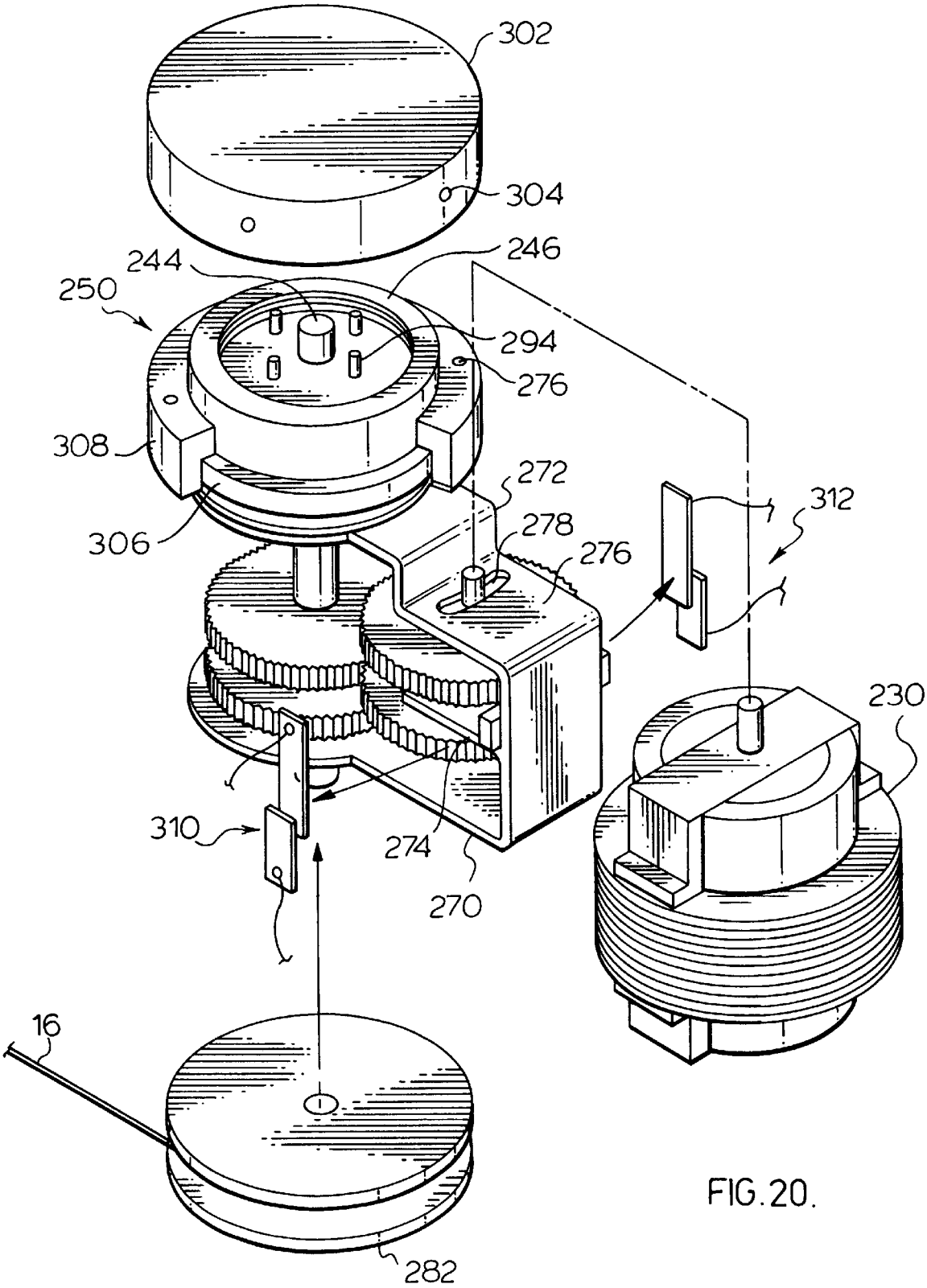
FIG. 20 is an exploded perspective view of the means for actuating the actuator arm shown in FIG. 19.

The front section 28 may be rotated 180° to the end section 26 in the directions shown by arrow C in FIG. 13. Specifically, the front face 140 of the end section 26 has a recess 142 which is approximately three quarters about the circumference of a plug 144 which extends from the front face 140. The plug 144 has a groove 145 proximate its distal end. As shown in FIG. 14, the plug 144 has a larger diameter contained within the wall 72 and has a flange 143 which fits within an annular recess in the wall 72 to maintain the plug 144 within the wall 72. Wires 146 pass through the plug 144 to connect the receiver circuit within the end section 26 to the motor 86. The front section 28 has a pawl 148 which fits into the recess 142 to allow rotation of the front section 28. The plug 144 fits through an aperture 150 in the front section 28. A ring 152 fits within the groove 145 to secure the end section 26 to the front section 28 and to allow movement of the front section 28. As noted above, rods 68 and 70 are inserted into the wall 72. Rings 147 and 149 fit about grooves 145 in the rods 68 and 70 to maintain them in place.

FIGS. 15A, 15B and 16A, 16B show a preferred circuit for the remote control transmitter 80 of the drapery actuator 20. The wireless remote control transmitter 80 may be fabricated from commercially available components such as resistors 154, integrated circuit 156, transistors 158, diodes 160, capacitors 162, light emitting diodes 164, battery 166, switch push buttons 168, pads 170 and coil 172. Connections may be made at selected ones of pads 11–20 to establish a unique transmission code. Corresponding connections are made on pads 1–10 in FIG. 18B to set the corresponding transmission code. This prevents a remote controller from transmitting a signal to an unintended drapery actuator 20. FIGS. 17A, 17B and 18A, 18B show a preferred circuit for the corresponding receiver circuit 179 contained within the end section 26 and which is fabricated from commercially available components such as those used for the remote control transmitter and DC jack 174, positive voltage regulator 176 and header 178, to provide appropriate power to motor 86 to operate it in forward and reverse directions.

Operation of the drapery actuator 20 to open and close drapes will be described with reference to FIGS. 1–18B.

In operation, the bracket 32 of the drapery actuator 20 is mounted on a support surface such as on the wall 17 as shown in FIGS. 1–4. The drapery actuator 20 engages the drapery cord 16. The front section 28 may be rotated, if required, to enable the drive pulley 132 to engage the drapery cord 16 in an appropriate manner when the drapery actuator 20 is mounted proximate the drapery cord 16. The drapery actuator 20 may also be mounted on the wall 17 in similar fashion in an upright position as shown in FIG. 3.

The housing 24 of the drapery actuator 20 is moved to different positions on the bracket 32 to ensure that the drapery cord 16 engages the drive pulley 132 under proper tension. Further tensioning of the drapery cord 16 about the drive pulley 132 is accomplished by using the tension maintenance mechanism 56. The tension maintenance mechanism 56 maintains proper engagement between the drapery cord 16 and the drive pulley 132, since the drapery cord 16 can lengthen slightly after use through wear or stretching of the drapery cord 16.

When drapery actuator 20 is correctly mounted to wall 17, the motor 86 can then be actuated by pressing the appropriate switch 168 on the remote controller 80 at some distance from the housing 24. Receiver circuit 179 receives the signal from the transmitter 80 and supplies appropriate power to the motor 86 to rotate the worm gear 88 which rotates gears 90 and 92. Gear 92 engages gear 107, thus, the rotation of motor 86 causes gears 107 and 108 to rotate and gear 110 which engages gear 108. The rotation of the gear 110 rotates the drive pulley 132 which is joined to the gear 110 by the collar 134.

When opening drapes 10 and 12 to a fully open position as shown in FIG. 1, drapes 10 and 12 encounter a stop 18 inhibiting further movement of the drapery cord 16. The drive pulley 132 and gear 110 stop when this preselected tension level on the drapery cord 16 has been met and the planetary gears 107 and 108 continue to rotate. The adjustable tension limiting means 119 is adjusted to set this preselected tension level. The gears 107 and 108 rotate around gears 92 and 110 thereby causing the actuator arm 94 to pivot towards the electrical switch 136. The actuator arm 94 then engages and closes the switch 136, thereby causing the motor 86 to stop.

To close drapes 10 and 12, an appropriate switch push button 168 on the remote controller 80 is selected to provide a signal to the receiver circuit 179 in the housing 24. Receiver circuit 179 supplies appropriate power to motor 86 to rotate the gears in the opposite direction to the rotation direction of the gears for opening drapes 10 and 12. As the drive pulley 132 winds the drapery cord 16 to close drapes 10 and 12, drapes 10 and 12 contact each other inhibiting further movement of the drapery cord 16. Once again, as the rotation of the drive pulley 132 and gear 110 ceases when the drapery cord 16 has met a preselected tension level, the planetary gears 107 and 108 rotate around gears 92 and 110 thereby causing the actuator arm 94 to pivot and contact and close the electrical switch 138 causing the motor 86 to stop. Setting of the preselected tension level will vary depending upon the size, arrangement and weight of drapes 10 and 12 and curtain rod 14 and/or other factors as will be apparent to those skilled in the art and can be determined empirically when installing the drapery actuator 20.

Adjusting wheel 122 of the adjustable tension limiting means 119 may be rotated to compress the compression spring 124 between the inner wheel 120 and the hub 116. This causes the friction between the hub 116, the rubber sheath 114 and between the rubber sheath 115 and the side 82 to increase. This increases the tension level in drapery cord 16 at which the actuator arm 94 will pivot between the electrical switches 136 and 138 and decreases the speed at which the actuator arm 94 pivots. Thus, the maximum tension level in the drapery cord 16 can be set as desired. For long draperies, the tension at which the actuator arm 94 will engage switches 136 and 138 must be increased otherwise the actuator arm 94 can prematurely engage switches 136 and 138 and cause the motor 86 to stop when drapes 10 and 12 are not fully closed or not fully open. The adjusting wheel 122 may also be manipulated to decrease the compression of the compression spring 124 such that the motor 86 is deactivated when drapes 10 and 12 are in a partially open position, if desired.

It will be realized that the drapery actuator 20 can be designed with a fixed preselected tension level and it is contemplated that this level would be selected as slightly less than the stall level of the motor 86. However, it is preferred to set the amount of compression of the drapes 10 and 12 when in an open position by using an adjustment mechanism as described above.

The drapery actuator 20 also has means to allow drapes 10 and 12 to be moved along the curtain rod 14 to a variety of selected positions. An appropriate switch 168 on the remote controller 80 is depressed and held which transmits a signal to the receiver circuit 179 within the housing 24 such that the motor 86 is actuated but switches 136 and 138 are not active. While this pad is depressed, the drapery actuator 20 moves the drapery cord 16 and drapes 10 and 12 in one direction. The movement of the drapery cord 16 ceases when the push pad is released, thus, the positioning of drapes 10 and 12 can be selected. Another similar switch 168 on the remote controller 80 moves the drapery cord 16 in the opposite direction by rotating the motor 86 in the opposite direction while the switch 168 is pressed and, again, switches 136 and 138 are not active. The actuator arm 94 will contact switches 136 and 138 but since switches 136 and 138 are not activated, the motor 86 does not automatically stop.

The remote controller 80 also has a switch 168 to stop the motor 86 when the actuator arm 94 is between the switches 136 and 138 to prevent further movement of the drapery cord 16 at any time after actuation of the motor 86.

FIGS. 19–22 show another embodiment of a drapery actuator 220 in accordance with the present invention. The drapery actuator 220 has a front section 222 with sides 224 and 226 and an end section 228. The front section 222 may be rotated 180° to the end section 228 based on the joinder of the front section 222 and end section 228 discussed above.

A reversible DC motor 230 or a universal motor is located in the front section 222 proximate the end section 228. A drive shaft 232 extends from the motor 230 and has a drive pulley 234 at its distal end.

A belt 236 connects the drive pulley 234 and a drive pulley 238. If required, it is contemplated that the drive pulleys 234 and 238 may be connected by a pair of belts 236. The drive pulley 238 has a gear 240 extending therefrom. The drive pulley 238 and the gear 240 are rotatable on a collar 242. The collar 242 rotates on a shaft 244 which is inserted within the collar 242 and passes through an aperture in an adjusting wheel 246 and through an aperture in the side 224 into the adjustable tension limiting means 250. The adjustable tension limiting means 250 is discussed below.

The gear 240 engages a gear 252 which has more teeth than the gear 240. The gear 252 has a gear 254 extending therefrom and which has fewer teeth than the gear 252. The gears 252 and 254 rotate on a shaft 256 which is affixed to a block 258 which protrudes from the side 226.

Gear 254 engages a gear 260 which has a gear 262 extending therefrom, gear 262 having fewer teeth than the gear 260. Gears 260 and 262 rotate on the shaft 244. Gear 262 engages planetary gear 264 which has another planetary gear 266 with fewer teeth extending therefrom. The planetary gears 264 and 266 rotate on a shaft 268 which is affixed to an arm 270 of an actuator arm 272 and an inner wall 274. The inner wall 274 is located between the arm 270 and another arm 276 of the actuator arm 272. The arm 276 has an arc-shaped aperture 278 which allows the actuator arm 272 to pivot within a predefined range.

The gear 266 engages a gear 280. The gear 280 and a drive pulley 282 are affixed to a collar 284 rotates on the shaft 244. A drive pulley 282 is disposed proximate the side 224 of the front section 222 and engages the drapery cord 16. The arm 276 of the actuator arm 272 pivots on the shaft 244 and the arm 270 pivots on the collar 284 at the same time. A rubber sheath 286 is affixed to the arm 270. Another rubber sheath 290 is affixed to the arm 276.

Figure 21:
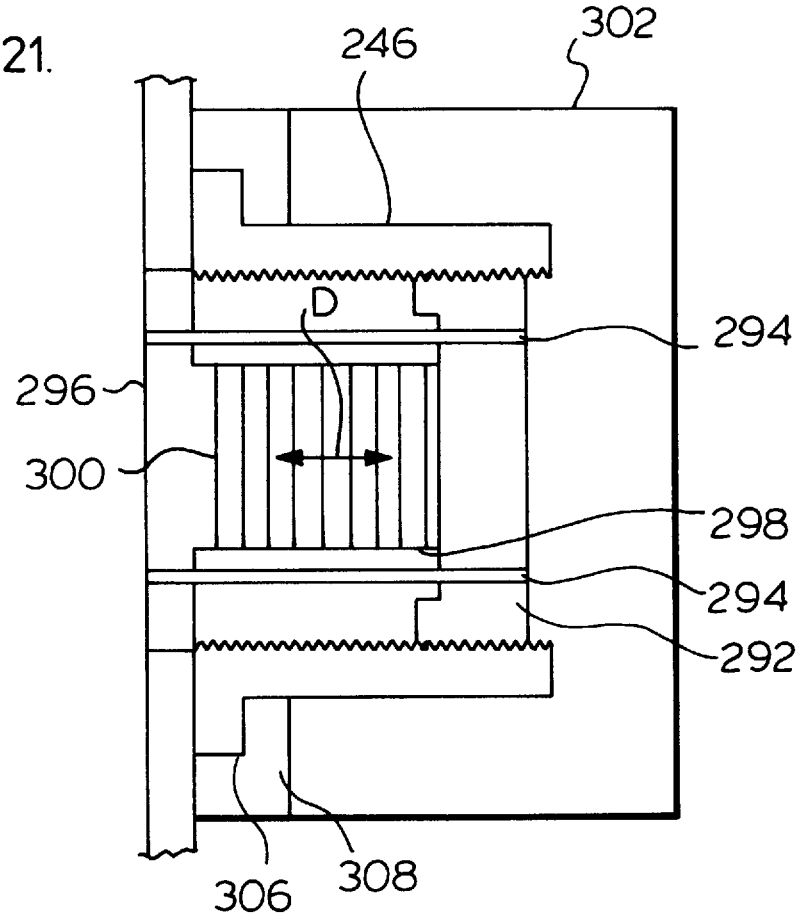
FIG. 21 is a cross-sectional top plan view of the adjustable tension limiting means of the drapery actuator shown in FIG. 19.
Figure 22:
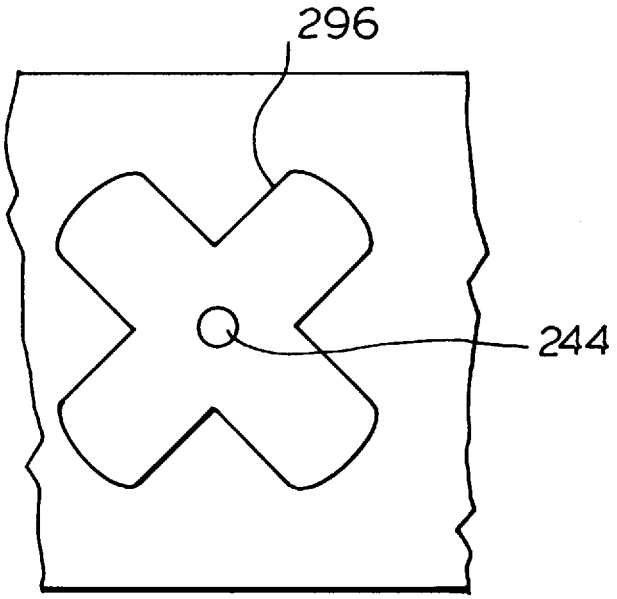
FIG. 22 is a fragmentary side view of the hub of the adjustable tension limiting means shown in FIG. 21.

The drapery actuator 220 contains an adjustable tension limiting means 250. The adjustable tension limiting means 250 comprises an adjusting wheel 246 which is threaded onto an inner wheel 292 (FIG. 21). The pins 294 join the inner wheel 292 to a hub 296. The pins 294 allow movement of the inner wheel 292 to and away from the hub 296, as shown by arrow D in FIG. 21, but prevent rotation of the inner wheel 292. The hub 296 has a shaft 298 and a compression spring 300 is about the shaft 298. As shown in FIG. 22, the hub 296 is substantially clover-shaped and fits within a clover-shaped opening in the side 226 such that the hub 296 does not rotate but moves to and away from the side 226 towards and away from the rubber sheath 290.

A first cover 302 has a plurality of screws 304 about its circumference which affix the cover 302 to the adjusting wheel 246.

The adjusting wheel 246 has a flange 306. A second cover 308 prevents the adjusting wheel 246 from being removed from the drapery actuator 220.

In operation, the cover 302 of the adjustable tension limiting means 250 is rotated in a first direction. This rotates the adjusting wheel 246 which rotates the inner wheel 292 along the shaft 298 of the hub 296. This compresses the spring 300. Compression of the spring 300 moves the hub 296 towards the rubber sheath 290 and, therefore, moves the rubber sheath 286 towards the side 224 which increases the friction on the arms 270 and 276 of the actuator arm 272 thereby changing the tension level in drapery cord 16 at which the actuator arm 272 pivots between normally open electrical switches 310 and 312. Rotation of the inner wheel 292 in the opposite direction allows the compression spring 300 to stretch thereby moving the hub 296 away from the rubber sheath 290 and decreasing the friction on the arms 270 and 276. This allows the tension level at which the actuator arm 272 will pivot to decrease.

Similar remote controller and receiver units may be used as described above and similar circuits may be used for such controls as described above. As with the preceding embodiment, a bracket and a tension maintenance mechanism may be provided to vary the tension of the drapery cord 16.

Operation of the drapery actuator 220 to open and close drapes will be described with reference to FIGS. 19–22. In operation, the drapery actuator 220 is mounted on a wall as described above. The drapery actuator may include a bracket and a tension maintenance mechanism as described above in respect of the first embodiment.

In operation, the bracket of the drapery actuator 220 is mounted on a support surface such as on a wall or ceiling. The drive pulley 282 engages the drapery cord 16 which engages drapes. The tension of the drapery cord 16 is adjusted appropriately.

The motor 230 is then actuated by pressing the appropriate switch on the remote controller at some distance from the drapery actuator 220. A receiver located in the drapery actuator 220 receives the signal from the remote controller and supplies appropriate power to the motor 230 which then rotates the drive pulley 234 which rotates the pulley 238 and gear 240 by belt 236. Gear 252 engages gear 240, thus, this action causes gears 252 and 254 to rotate about the shaft 256. The engagement of the gears then rotates gears 260, 262, 264, 266 and 280. The rotation of the gear 280 rotates the drive pulley 282 which is joined to the gear 280 by the collar 284. The drapes may then be opened or closed depending upon the direction or rotation of motor 230.

Upon the drapes reaching an extreme position such as a fully open position, the drapes encounter a stop inhibiting further movement of drapery cord 16. The drive pulley 282 and gear 280 slow to a stop when the drapery cord 16 has reached a preselected tension level and the motor 230 causes the planetary gears 264 and 266 to continue to rotate, thus, the gears 264 and 266 rotate about gear 280 thereby causing the actuator arm 272 to rotate towards the electrical switch 310. The actuator arm 272 then abuts and closes the switch 310, thereby causing the motor 230 to stop.

To close the drapes, an appropriate switch on the remote controller is pressed to provide a signal to the receiver circuit in the drapery actuator 220. The motor 230 then rotates the gears in the opposite direction to the rotation of the gears for opening the drapes. As the drive pulley 282 winds the drapes towards each other to close the drapes, the drapes contact each other inhibiting further movement of the drapery cord 16. Once again, the rotation of the drive pulley 286 and gear 280 stops when the drapery cord 16 has reached this preselected tension level thereby causing the planetary gears 264 and 266 to abut and close the electrical switch 312 causing the motor 230 to stop.

As with the drapery actuator 20, the drapery actuator 220 also has means to allow the drapes to be moved along a curtain rod to a variety of selected positions.

Figure 23:
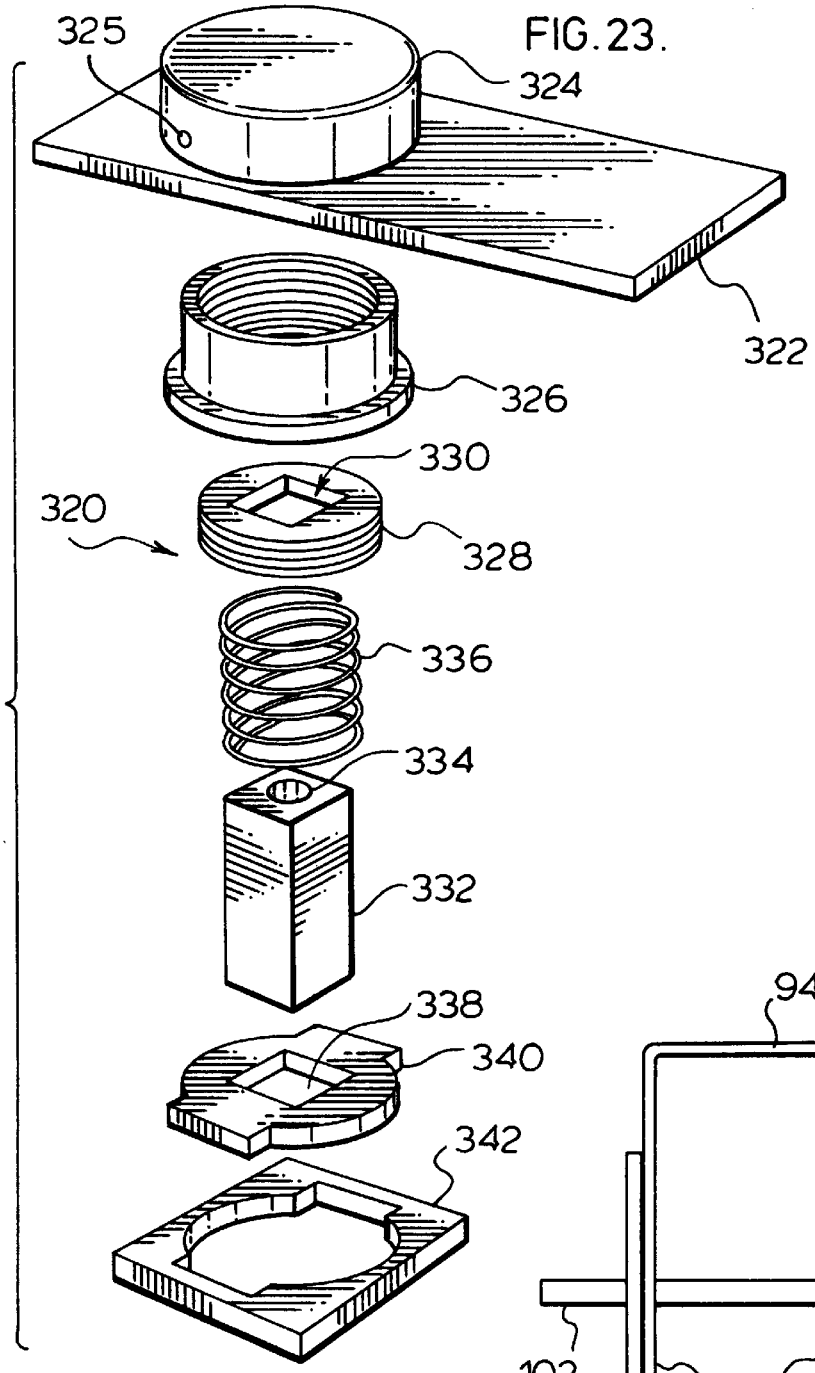
FIG. 23 is a fragmentary exploded perspective view of another embodiment of an adjustable tension limiting means.
Figure 24:
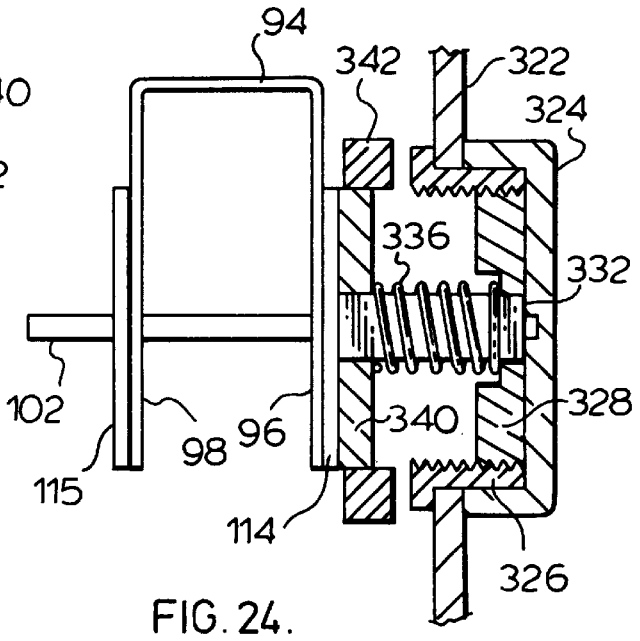
FIG. 24 is a partial fragmentary cross-sectional top plan view of the adjustable tension limiting means of FIG. 23 within the drapery actuator shown in FIG. 1.

FIGS. 23 and 24 show another embodiment of an adjustable tension limiting means indicated generally at 320 which can be used with the drapery actuator 20 or the drapery actuator 220 or the like. The drapery actuator has a side 322. A cover 324 has a number of screws 325 about its circumference which affix the cover 324 to an adjusting wheel 326. The adjusting wheel 326 is threaded onto an inner wheel 328 which has a square shaped aperture 330 for receiving a square-shaped block 332. The block 332 has an aperture 334 to allow a shaft such as shaft 102 of the drapery actuator 20 of FIG. 9 to pass through the block 332. A compression spring 336 is disposed about the block 332. The block 332 fits within a square aperture 338 of a plate 340 and is affixed to the plate 340. The plate 340 fits within another plate 342 which abuts the top and bottom of the drapery actuator such as the top 29 and the bottom (not shown) of the drapery actuator 20 between the sides 82 and 84 of the front section 28 of the drapery actuator 20.

FIG. 24 shows this embodiment of the adjustable tension limiting means 320 in use with the drapery actuator 20 of FIG. 1.

In operation, the cover 324 is rotated in a first direction. This rotates the adjusting wheel 326 which moves the inner wheel 328 along the block 332 and moves the plate 340 towards a rubber sheath of the drapery actuator 20 to increase the friction between the rubber sheath 114 and the plate 340 thereby increasing the preselected tension level. Rotation of the cover 324 in the opposite direction allows the compression spring 336 to extend thereby decreasing the friction between the plate 340 and the rubber sheath 114.

It will be understood that the drapery actuator can have a plurality of drive pulleys to engage one drapery cord or a plurality of drapery cords.

Although the disclosure describes and illustrates preferred embodiments of the invention, it is to be understood that the invention is not limited to these particular embodiments. Many variations and modifications will now occur to those skilled in the art. For definition of the invention, reference is to be made to the appended claims.

I claim:

1. A drapery actuator to open and close a drape, comprising:

a housing;

a drive pulley, supported by said housing adapted to engage a drapery cord operatively coupled to said drape;

a motor, supported by said housing, adapted to provide torque for reversibly rotating said drive pulley so as to move said drapery cord in a first direction to a first position to move said drapery cord in a second opposite direction to a second position;

a first electrical switch operatively connected to said motor;

a second electrical switch operatively connected to said motor;

torque-activated switch means, adapted to actuate said first electrical switch when said drive pulley moves said drapery cord to said first position and further adapted to actuate said second electrical switch when said drive pulley is reversibly rotated by said motor to move said drapery cord to said second position, so as to cause said first electrical switch to deactivate said motor when said drapery is moved to said first position thereby preventing further movement and to cause said second electrical switch to deactivate said motor when said drapery cord is moved to said second position thereby preventing further movement of said drapery cord in said second opposite direction.

2. A drapery actuator as claimed in claim 1 wherein said torque-actuated switch means is an actuator arm pivotable between a first position where it actuates said first electrical switch and a second position where it actuates said second electrical switch.

3. A drapery actuator as claimed in claim 2 wherein said actuator arm pivots between said first position and said second position upon said torque provided by said motor to said drive pulley reaching an upper limit.

4. A drapery actuator as claimed in claim 1 wherein said housing includes a receiver circuit to receive a signal from a remote control to actuate said motor.

5. A drapery actuator as claimed in claim 1 wherein said drapery actuator is hard wired to at least one electric switch to actuate said motor.

6. A drapery actuator as claimed in claim 1 wherein said motor is a direct current motor.

7. A drapery actuator as claimed in claim 1 wherein said motor is a reversible motor.

8. A drapery actuator as claimed in claim 1 wherein said actuator is mounted to a support surface with a mounting bracket.

9. A drapery actuator as claimed in claim 8 additionally comprising adjustment means to variably position said drive pulley so as to permit variable adjustment of tension in said drapery cord.

10. A drapery actuator as claimed in claim 8 wherein said support surface is a wall.

11. A drapery actuator as claimed in claim 8 wherein said support surface is a ceiling.

12. A drapery actuator as claimed in claim 9 wherein said housing has means for varying the position of said housing and said drive pulley relative to said mounting bracket thereby varying the tension in said drapery cord.

13. A drapery actuator as claimed in claim 9 wherein said housing comprises a front section and an end section and said drive pulley and said motor are supported by said front section and wherein said end section has means for varying the position of said housing and drive pulley relative to said mounting bracket thereby varying the tension on said drapery cord.

14. A drapery actuator as claimed in claim 9 wherein said mounting bracket has means for varying the relative position of said housing on said support surface, thereby varying the tension on said drapery cord.

15. A drapery actuator as claimed in claim 9 wherein said housing is adapted to selectively engage said bracket in any of a plurality of positions for varying the position of said housing relative to said support surface and thereby varying the tension on said drapery cord.

16. A drapery actuator as claimed in claim 13 wherein said front section is rotatably mounted to said end section.

17. A drapery actuator as claimed in claim 16 wherein said front section is rotatable 180 degrees relative to said end section.

18. The drapery actuator as claimed in claim 3, wherein said upper limit is adjustably preselectable.

19. The drapery actuator as claimed in claim 18, wherein said upper limit is adjustably preselectable by varying the rotational friction which occurs between said actuator arm and said housing when said motor is actuated.

20. The drapery actuator as claimed in claim 3, further comprising:

drape movement limiting means to prevent further movement of said drapery cord in said first direction when said drapery cord is at said first position and to prevent further movement of said drapery cord in said second direction when said drapery cord is at said second position, wherein said drape movement limiting means causes said torque provided by said motor to said drive pulley to reach said upper limit upon said drapery cord being moved to each of said first and second positions.

* * * * *